US005653906A

United States Patent [19]

Fowler et al.

[11] Patent Number: 5,653,906

[45] Date of Patent: Aug. 5, 1997

[54] CONTROL SYSTEM FOR A MICROWAVE OVEN, A MICROWAVE OVEN USING SUCH A CONTROL SYSTEM AND METHODS OF MAKING THE SAME

[75] Inventors: Daniel L. Fowler, Kentwood; Greg R. Pattok, Holland; Bruce E. Tanis, Hudsonville, all of Mich.

[73] Assignee: Robertshaw Controls Company, Richmond, Va.

[21] Appl. No.: 332,112

[22] Filed: Oct. 31, 1994

Related U.S. Application Data

[63] Continuation-in-part of Ser. No. 301,592, Sep. 7, 1994.

[51] Int. Cl.[6] ..... H05B 6/68

[52] U.S. Cl. ..... 219/716; 219/702; 219/710; 219/760; 323/301

[58] Field of Search ..... 219/716, 717, 219/760, 702, 710; 323/299, 301, 258, 255

[56] References Cited

U.S. PATENT DOCUMENTS

| | | | |
|---|---|---|---|
| 4,733,158 | 3/1988 | Marchione et al. | 323/258 |
| 4,843,201 | 6/1989 | Smith et al. | 219/716 |
| 4,843,301 | 6/1989 | Belanger | 323/299 |
| 4,939,331 | 7/1990 | Berggren et al. | 219/717 |
| 5,001,318 | 3/1991 | Noda | 219/716 |
| 5,075,617 | 12/1991 | Farr | 323/258 |
| 5,212,360 | 5/1993 | Carlson | 219/716 |
| 5,274,208 | 12/1993 | Noda | 219/716 |
| 5,347,109 | 9/1994 | Nakabayashi et al. | 219/716 |

FOREIGN PATENT DOCUMENTS

| | | | |
|---|---|---|---|
| 3741381 | 2/1990 | Germany | 219/716 |
| 2-37691 | 2/1990 | Japan | 219/760 |
| 6-267653 | 9/1994 | Japan | 219/716 |

OTHER PUBLICATIONS

Prior known control system for a microwave oven having only one microprocessor for the display and power modules thereof.

Prior known control system for a microwave oven having a plurality of different voltage taps on the magnetron means thereof.

Prior known control system for a microwave oven having line means to interconnect an electrical power source to the transformer means of the magnetron means thereof.

*Primary Examiner*—Philip H. Leung

*Attorney, Agent, or Firm*—Fulbright & Jaworski L.L.P.

[57] ABSTRACT

A control system for a microwave oven having a magnetron unit, a microwave oven using such a control system and methods of making the same are provided, the system being adapted to interconnect a power source to a transformer unit of the magnetron unit to operate the same, the system comprising a unit for determining the actual voltage level of said power source to be utilized at that time and being adapted to interconnect the power source to a particular tap of the transformer unit if the determined power level is above a certain value and to interconnect the power source to another tap of the transformer unit if the determined power level is below the certain value.

25 Claims, 28 Drawing Sheets

+5V
R56
10K
D6
D7
R61
510
Q3
2N2222A
Q4
2N2907A
R62
R64
Q5
2N2907A
R59
27K
2%
R58
27K
2%
R60
27K
2%
C2
.01UF
R63
10.2K
1%
R57
5.6
DS1
FILAMENT
FILAMENT
GRID 9
GRID 8
GRID 7
GRID 6
GRID 5
GRID 4
GRID 3
GRID 2
GRID 1
R55
180K
-27V
R54
180K
COMMON
R53
180K
COMMON
-27V
R52
180K
COMMON
U1
HMCS4019
(E) D4
(E) D5
(E) D6
(E) D7
(E) D8
(E) D9
(E) D10
(E) D11
(E) D12

| | |
|---|---|
| FIG. 4A | FIG. 4B |
| FIG. 4C | FIG. 4D |
| FIG. 4E | FIG. 4F |

J5'
MAG 2 LO V 7A @ 200VAC
MAG 3 LO V 7A @ 240VAC
MAG 2 HI V 7A @ 200VAC
MAG 3 HI V 7A @ 240VAC
K3B'
K5B'
K4B'
K6B'
22A
15A
8A
MAG2PL
E3
L1
J4'
MAG # 3
MAG # 2
R72'
R74'
330 .5W
R71'
R73'
180 .5W
U3' MOC3021T
U4' MOC3021T
D13' 1N4004
D12' 1N4004
R56' 100
C14' 47UF 16V
R57' 100
C15' 47UF 16V
VR
K7A'
K8A'
D14' 1N4004
D15' 1N4004
R68' 1.3K
R69' 1.3K
2N2222A
Q8'
Q9'
Q10'
Q11'
Q12'
Q13'
R60' 3.9K
R61' 3.9K
R62' 3.9K
R63' 3.9K
R64' 27K
R65' 27K
U1'
R11
R20
R12
R13
R21
R22

| | |
|---|---|
| FIG. 6A | FIG. 6B |
| FIG. 6C | FIG. 6D |
| FIG. 6E | FIG. 6F |

| | | | |
|---|---|---|---|
| FIG. 10A | FIG. 10B | FIG. 10C | FIG. 10D |
| FIG. 10E | FIG. 10F | FIG. 10G | FIG. 10H |

CONTROL SYSTEM FOR A MICROWAVE OVEN, A MICROWAVE OVEN USING SUCH A CONTROL SYSTEM AND METHODS OF MAKING THE SAME

CROSS REFERENCE TO RELATED PATENT APPLICATION:

This patent application is a continuation-in-part patent application of its copending parent patent application, Ser. No. 301,592, filed Sep. 7, 1994.

BACKGROUND OF THE INVENTION

1. Field of the Invention

This invention relates to a new control system for a microwave oven having magnetron means and to a new method of making such a control system 2. Prior Art Statement It is known to provide a control system for a microwave oven having magnetron means, the system being adapted to interconnect a power source to the magnetron means to operate the same, the system comprising a display control module, a power module, and electrical circuit means interconnecting the modules together, the modules having a single microprocessor.

It is also known to provide a control system for a microwave oven having magnetron means comprising transformer means provided with a plurality of different voltage tap means, the control system comprising electrical circuit means to interconnect an electrical power source to the transformer means to operate the magnetron means, It is also known to provide a control system for a microwave oven having magnetron means comprising transformer means, the control system comprising electrical circuit means to interconnect an electrical power source through line means to the transformer means to operate the magnetron means.

SUMMARY OF THE INVENTION

It is one of the features of this invention to provide a new control system for a microwave oven having magnetron means by separating the display control module from the power module, even though electrical circuit means interconnect the modules together, and by providing each of the modules with its own microprocessor.

In particular, it has been found according to the teachings of this invention that the display control module can be located in the front portion of the microwave oven and the power module can be located in another area of the microwave oven remote from the display control module and each module can have its own microprocessor which can be operatively interconnected to the microprocessor of the other module by the electrical circuit means so as to communicate therebetween.

For example, one embodiment of this invention comprises a control system for a microwave oven having magnetron means, the system being adapted to interconnect a power source to the magnetron means to operate the same, the system comprising a display control module, a power module, and electrical circuit means interconnecting the modules together, each of the modules comprising a microprocessor.

It is another feature of this invention to provide a new control system for a microwave oven having magnetron means and wherein the control system is adapted to interconnect the power source being utilized at that time to a particular tap means of the transformer means of the magnetron means in relation to the actual voltage level of that power source.

For example, another embodiment of this invention comprises a control system for a microwave oven having magnetron means comprising transformer means provided with a plurality of different voltage tap means, the control system comprising electrical circuit means to interconnect an electrical power source to the transformer means to operate the magnetron means, the control system comprising means for determining the actual voltage level of the power source to be utilized at that time and being adapted to interconnect the power source to a particular tap means if the determined power level is above a certain value and to interconnect the power source to another of the tap means if the determined power level is below that certain value.

It is another feature of this invention to provide a new control system for a microwave oven having magnetron means and wherein the control system is adapted to determine the actual amperage of the electrical current flowing from a power source to the transformer means of the magnetron means at that time so as to monitor the operating condition of the magnetron means.

For example, another embodiment of this invention comprises a control system for a microwave oven having magnetron means comprising transformer means, the control system comprising electrical circuit means to interconnect the electrical power source through line means to the transformer means to operate the magnetron means, the control system comprising means to determine the actual amperage of the electrical current flowing from the power source through the line means to the transformer means at that time so as to monitor the operating condition of the magnetron means.

Accordingly, it is an object of this invention to provide a new control system for a microwave oven having magnetron means, the system of this invention having one or more of the novel features of this invention as set forth above or hereinafter shown or described.

Another object of this invention is to provide a new method of making such a control system, the method of this invention having one or more of the novel features of this invention as set forth above or hereinafter shown or described.

Another object of this invention is to provide a new microwave oven using such a control system, the microwave oven of this invention having one or more of the novel features of this invention as set forth above or hereinafter shown or described.

Another object of this invention is to provide a new method of making such a microwave oven, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 2A illustrates a part of the control system of the display control module.

FIG. 2B illustrates another part of the control system of the display control module.

FIG. 2C illustrates another part of the control system of the display control module.

FIG. 2D illustrates another part of the control system of the display control module.

FIG. 2E illustrates another part of the control system of the display control module.

FIG. 2F illustrates another part of the control system of the display control module.

FIG. 4A illustrates a part of the control system of the power module.

FIG. 4B illustrates another part of the control system of the power module.

FIG. 4C illustrates another part of the control system of the power module.

FIG. 4D illustrates another part of the control system of the power module.

FIG. 4E illustrates another part of the control system of the power module.

FIG. 4F illustrates another part of the control system of the power module, FIG. 4F also illustrating schematically part of the microwave oven utilizing the control system of this invention and one of the three magnetrons thereof operatively interconnected to the power module.

FIG. 6A illustrates part of the control system of the local operating network module.

FIG. 6B illustrates another part of the control system of the local operating network module.

FIG. 6C illustrates another part of the control system of the local operating network module.

FIG. 6D illustrates another part of the control system of the local operating network module.

FIG. 6E illustrates another part of the control system of the local operating network module.

FIG. 6F illustrates another part of the control system of the local operating network module.

FIG. 8A schematically illustrates a part of the control system of this invention for a microwave oven.

FIG. 8B schematically illustrates another part of the control system of this invention for a microwave oven.

FIG. 10A schematically illustrates a part of the control system of this invention for a microwave oven.

FIG. 10B schematically illustrates another part of the control system of this invention for a microwave oven.

FIG. 10C schematically illustrates another part of the control system of this invention for a microwave oven.

FIG. 10D schematically illustrates another part of the control system of this invention for a microwave oven.

FIG. 10E schematically illustrates another part of the control system of this invention for a microwave oven.

FIG. 10F schematically illustrates another part of the control system of this invention for a microwave oven.

FIG. 10G schematically illustrates another part of the control system of this invention for a microwave oven.

FIG. 10H schematically illustrates another part of the control system of this invention for a microwave oven.

DESCRIPTION OF THE PREFERRED EMBODIMENT

Figures 1, 2A:
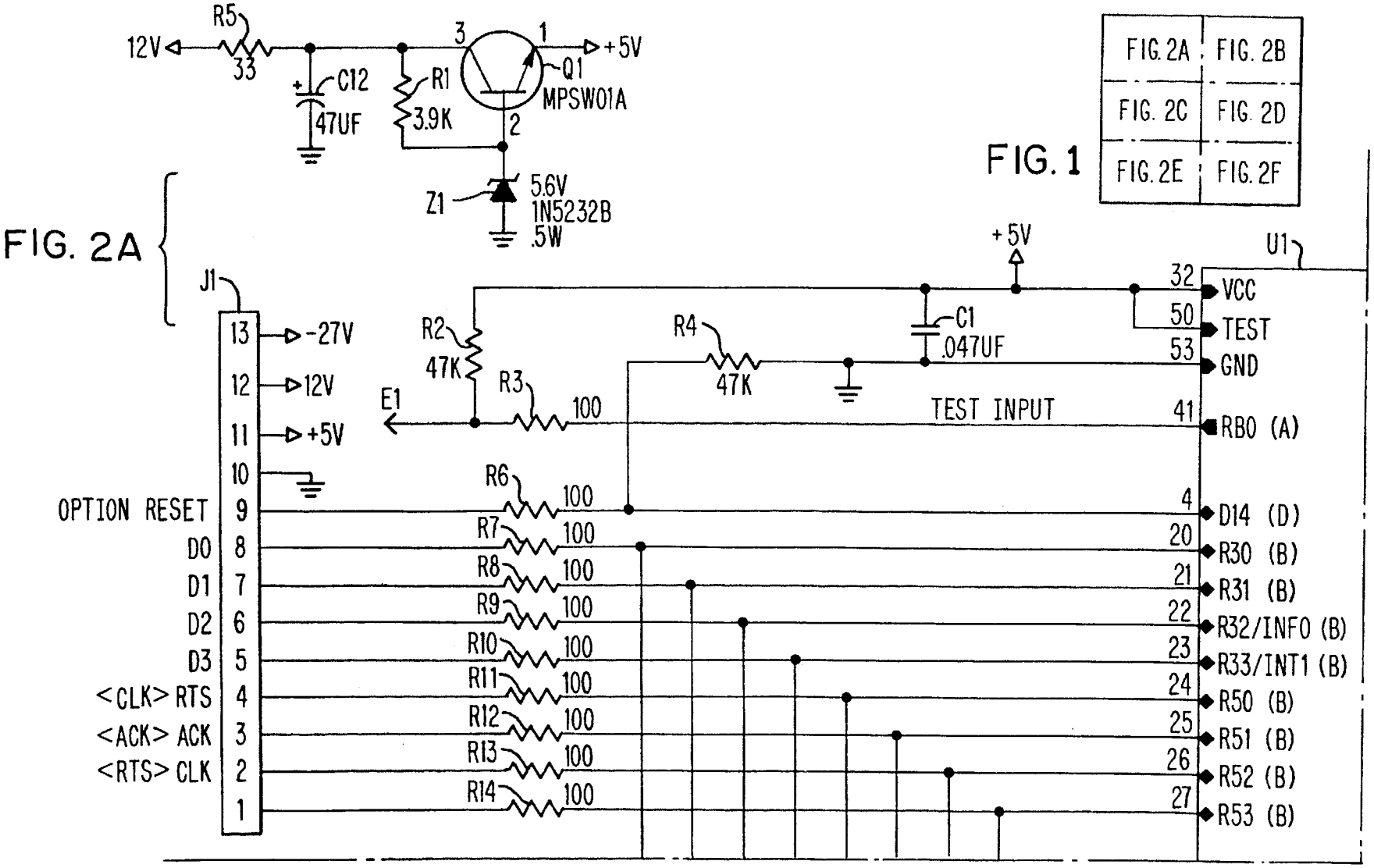
FIG. 1 is a block diagram illustrating how
FIGS. 2A–2F are to be positioned together to provide the control system of the display control module of the control system of this invention.

While the various features of this invention are hereinafter illustrated and described as being particularly adapted to provide a control system for a microwave oven, it is to be understood that the various features of this invention can be utilized singly or in various combinations thereof to provide a control system for other appliances or apparatus as desired.

Therefore, this invention is not to be limited to only the embodiment illustrated in the drawings, because the drawings are merely utilized to illustrate one of a wide variety of uses of this invention.

Figures 3, 4A:
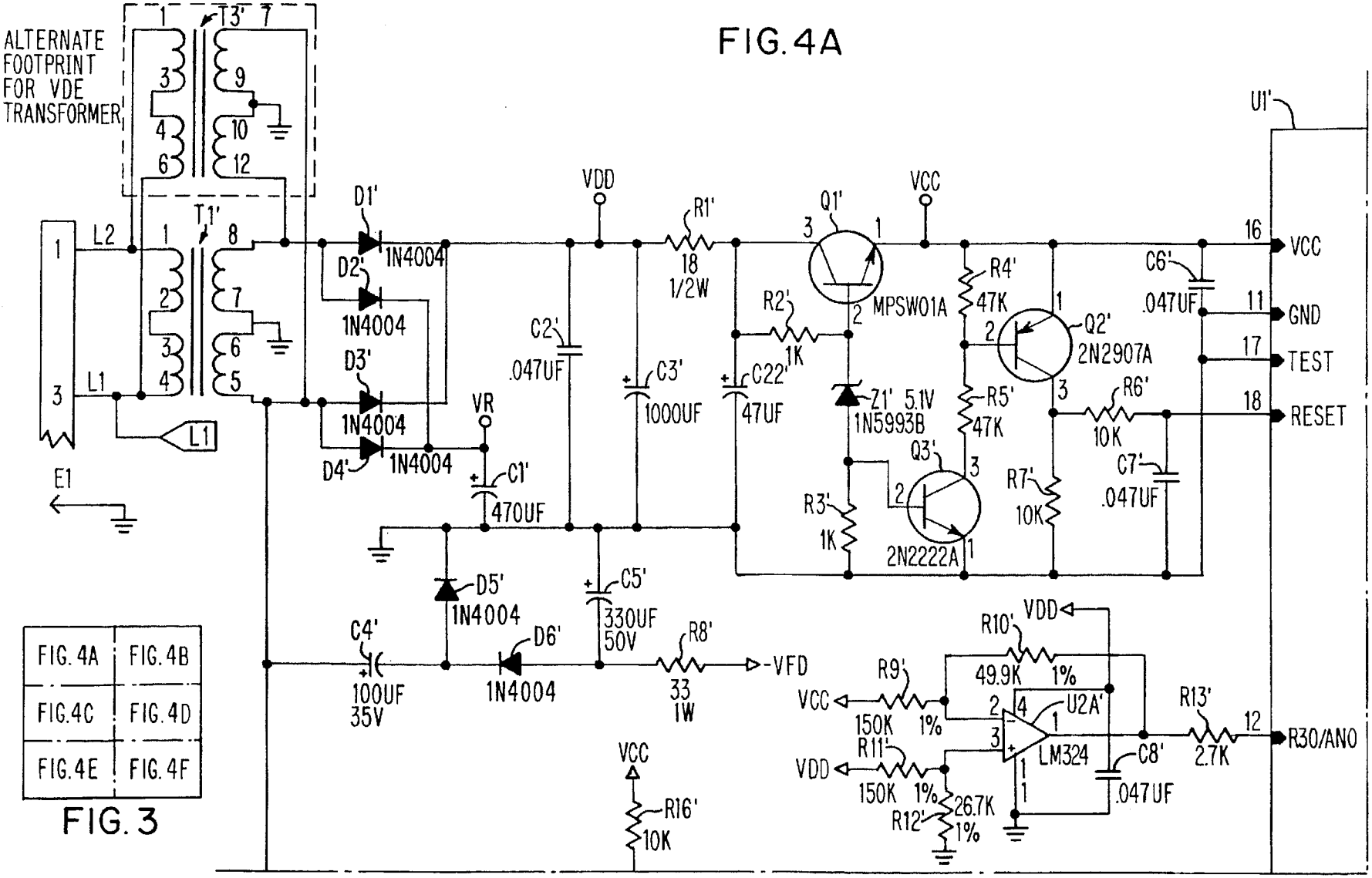
FIG. 3 is a block diagram illustrating how
FIGS. 4A–4F are to be positioned together to provide the control system of the power module of the control system of this invention.
Figure 4B:
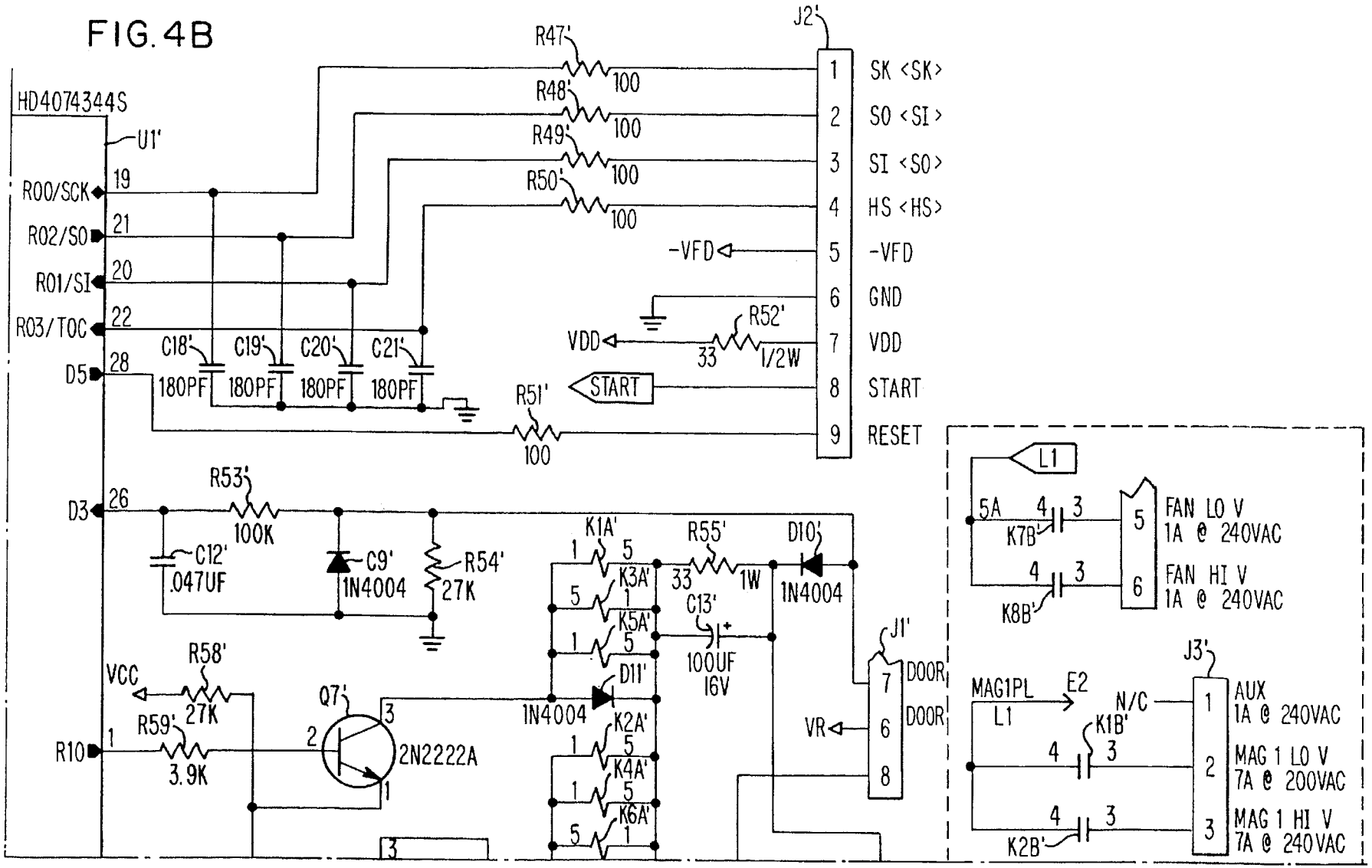
Figure 4C:
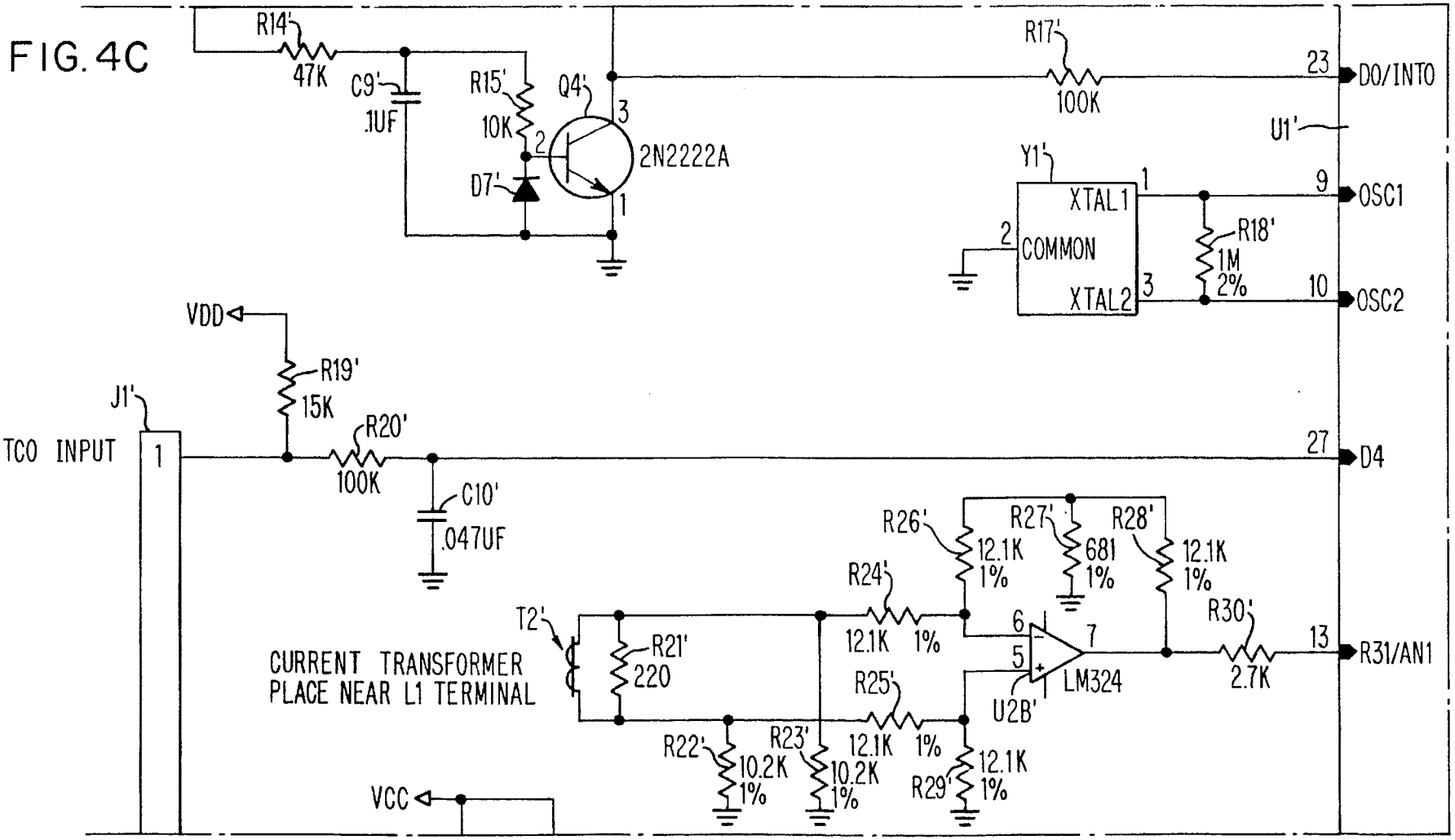
Figure 4D:
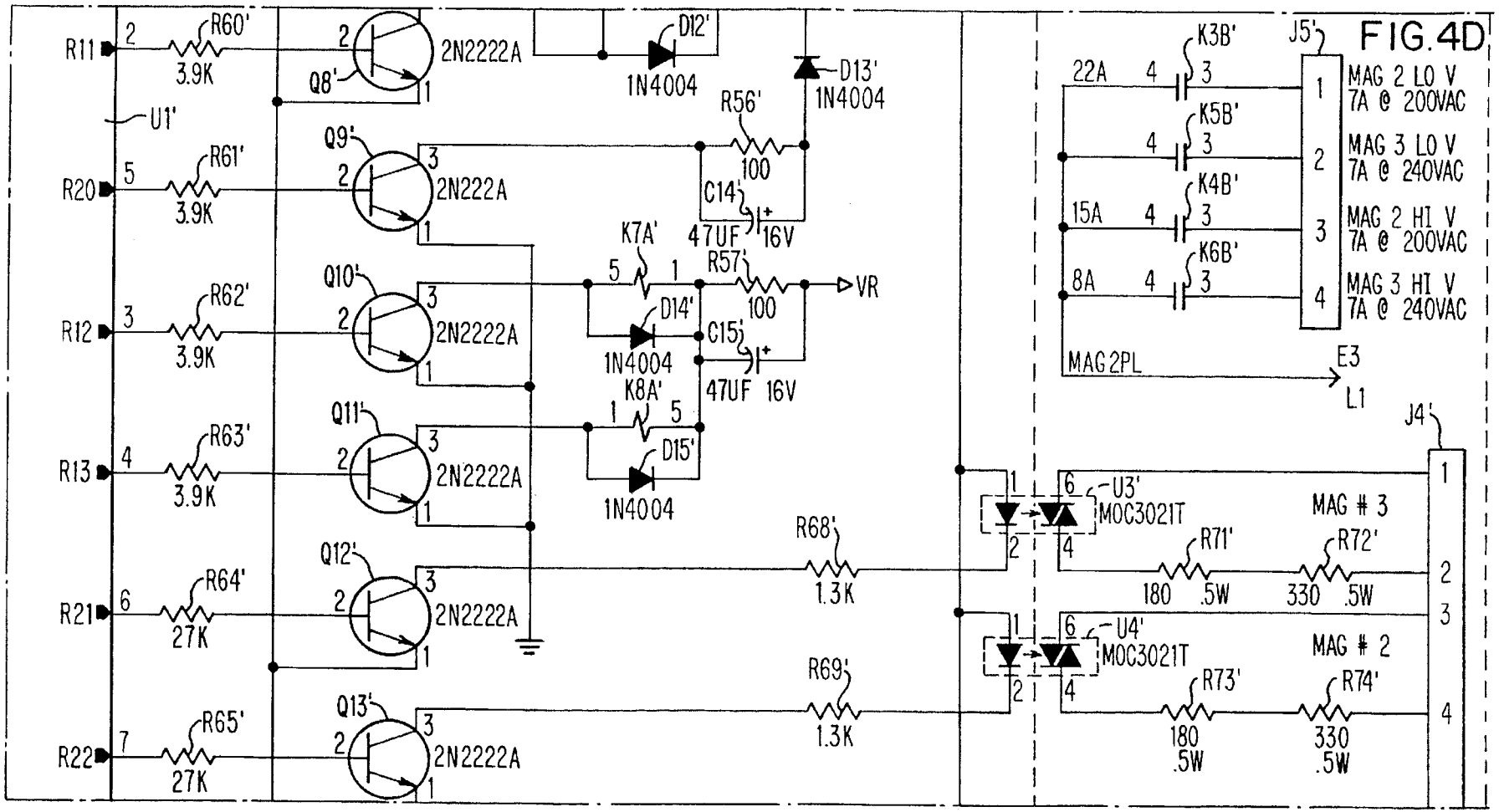
Figure 4E:
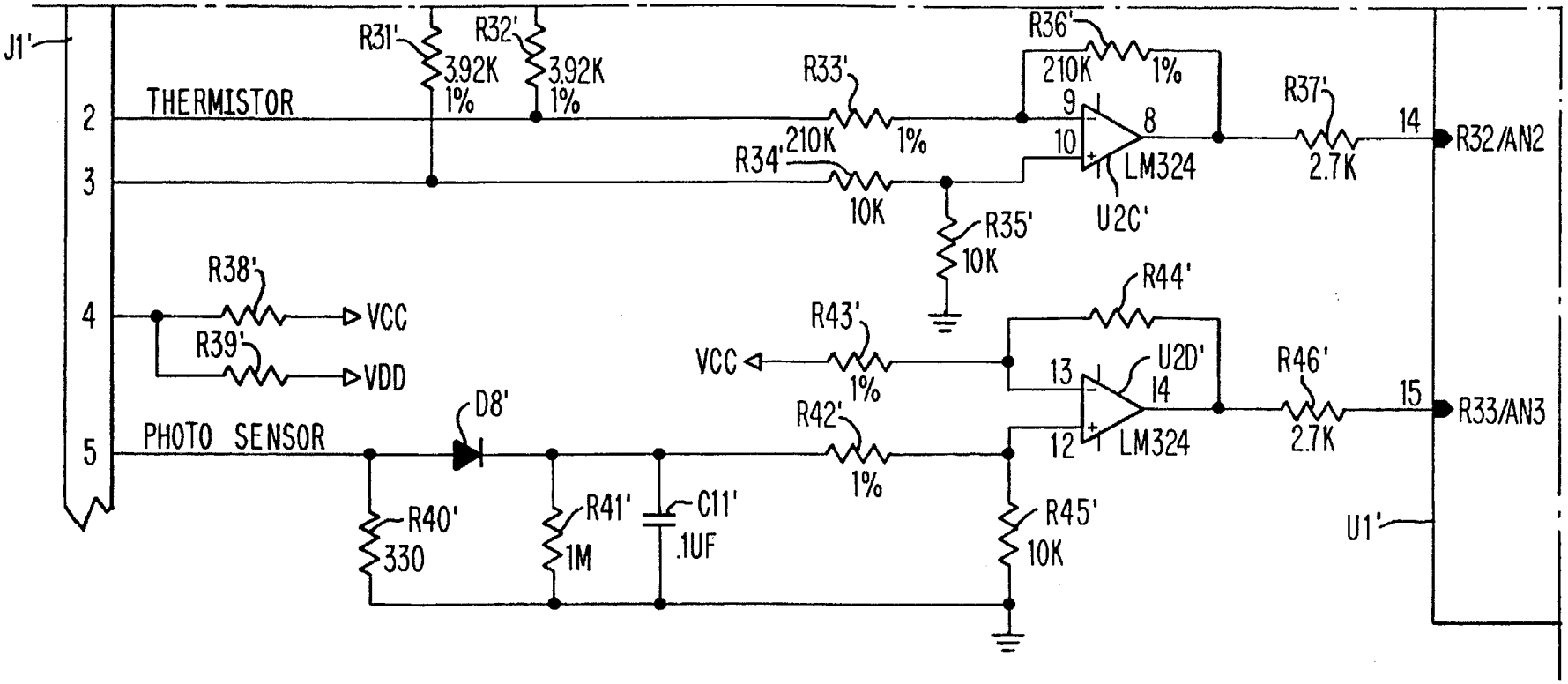
Figure 4F:
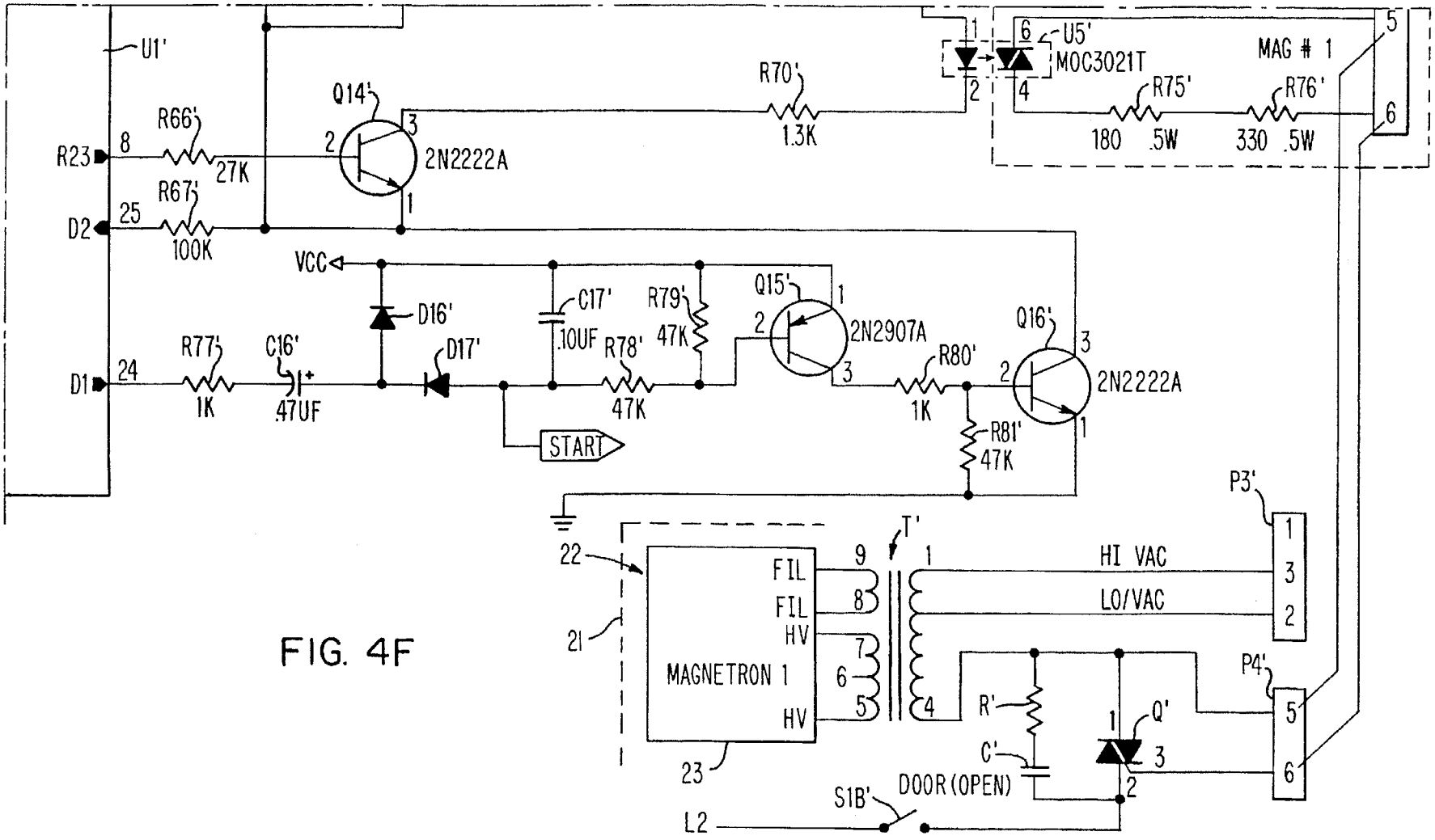
Figure 8A:
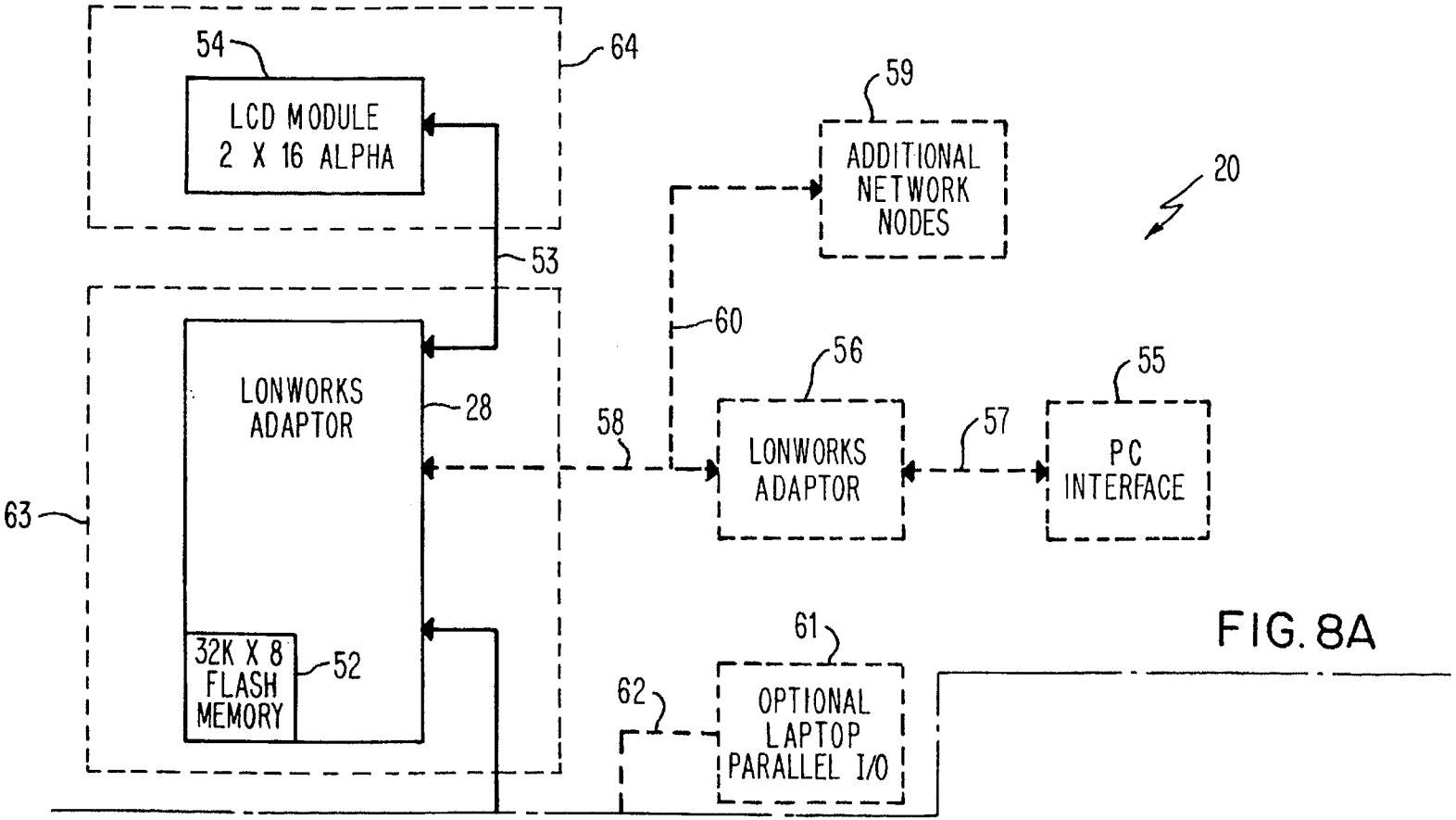
FIGS. 8A and 8B are to be positioned together to provide the control system of this invention for a microwave oven.
Figure 8B:
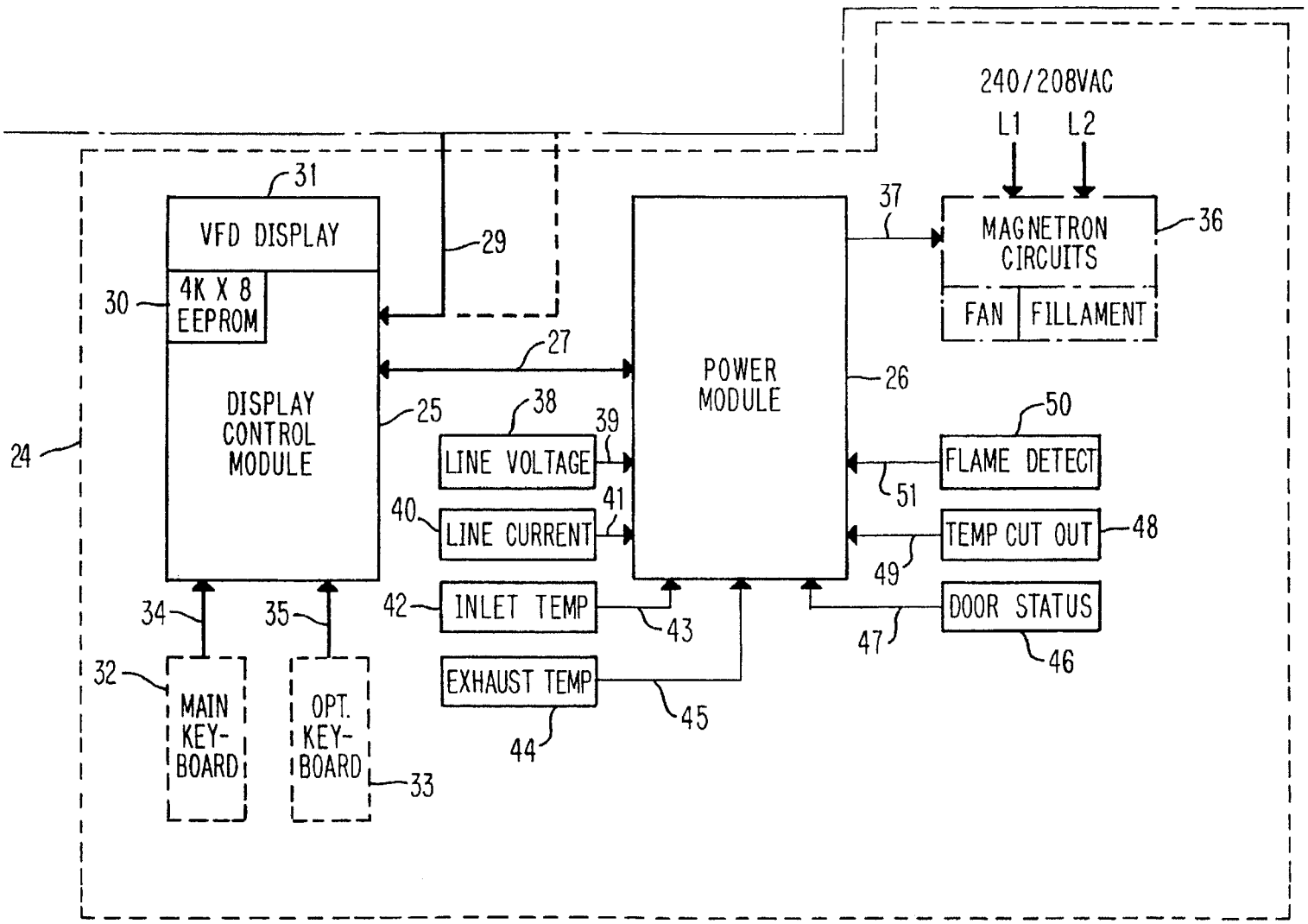
Figures 9, 10A:
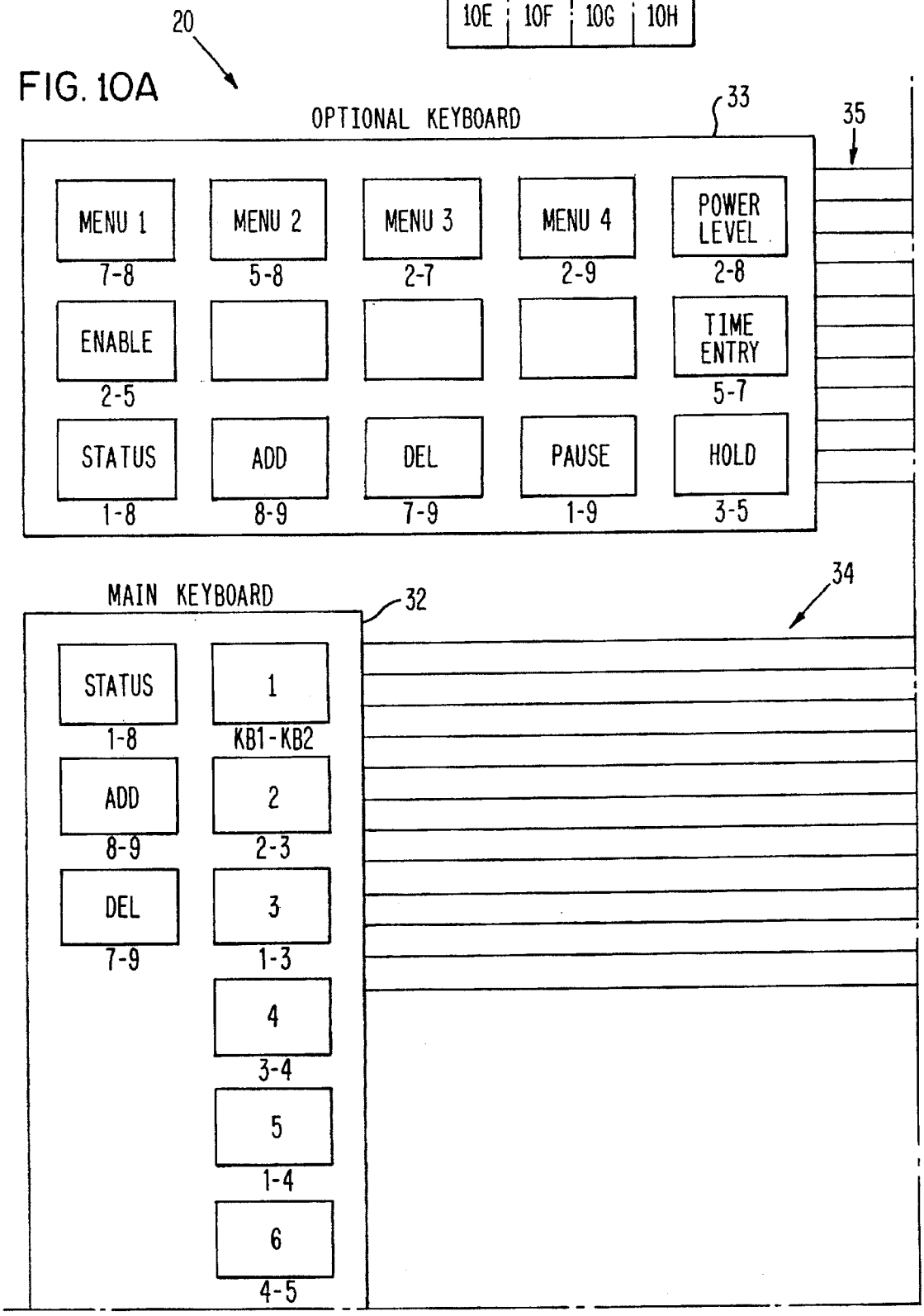
FIG. 9 is a block diagram illustrating how
FIGS. 10A–10H are to be positioned together to provide the control system of this invention for a microwave oven, FIGS. 10A–10H while being schematic providing more detail than the schematic of FIGS. 8A and 8B.

Referring now to FIGS. 8A and 8B, the new control system of this invention for a microwave oven is generally indicated by the reference numeral 20 and the microwave oven that is being controlled by such system 20 is schematically illustrated by a dashed line 21 in FIG. 4F and having magnetron means therein that are generally indicated by the reference numeral 22. While the microwave oven 21 can have any number of magnetrons therein, only one magnetron 23 is schematically illustrated in FIG. 4F. However, the microwave oven 21 illustrated in FIG. 10H actually has three magnetrons 23, 23' and 23" each being interconnected to the control system 20 of this invention in a manner similar to the magnetron 23 that is illustrated in FIG. 4F. Thus, it can be seen that while FIGS. 10A–10H illustrate the system 20 of this invention in more detail than FIGS. 8A and 8B, it is believed that FIGS. 8A and 8B should be described first and the same reference numerals being described therefor are being applied in FIGS. 10A–10H where appropriate.

Figure 7:
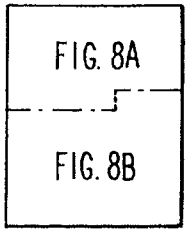
FIG. 7 is a block diagram illustrating how

As illustrated in FIG. 8B, a dotted line 24 indicates a part of the control system 20 which can be utilized without the remaining part of the control system 20 that is illustrated in FIG. 8A to provide a "low line" control system for a microwave oven. However, when the remainder of the control system 20 of this invention is interconnected to the part 24 of the control system 20 by combining FIGS. 8A and 8B in the manner illustrated in FIG. 7, the control system 20 will provide a "high line" control system for a microwave oven as will be apparent hereinafter.

The part 24 of the control system 20 has a display control module 25 and a power module 26 disposed remote from the display control module 25 and being operatively interconnected thereto by electrical circuit means 27. Similarly, as illustrated in FIG. 8A, the control system 20 comprises a local operating network module 28 disposed remote from the display control module 25 and being operatively interconnected thereto by electrical circuit means 29, the local operating network module 28 being labeled "LONworks adapter" which is sold by the Echelon Corporation of Palo Alto, Calif. and the word "LONworks" is a trademark of such Echelon Corporation.

The display control module 25 as illustrated in FIG. 8B has an EEPROM 30, a vacuum florescent display 31, a main keyboard 32 and an optional keyboard 33, the keyboards 32 and 33 being operatively interconnected to the display control module by electrical circuit means 34 and 35.

The power module 26 as illustrated in FIG. 8B is interconnected to magnetron circuits 36 by electrical circuit means 37 and main power source leads L1 and L2 are interconnected to the magnetron circuits 36 as illustrated.

The power module 26 is adapted to sense line voltage 38 through electrical circuit means 39, line current 40 through electrical circuit means 41, inlet temperature 42 through electrical circuit means 43, exhaust temperature 44 through electrical circuit means 45, oven door status 46 through electrical circuit means 47, temperature cutout 48 of the microwave oven through electrical circuit means 49 and flame detect 50 of the microwave oven through electrical circuit means 51.

As illustrated in FIG. 8A, the LONworks adapter 28 has a flash memory 52 and is operatively interconnected by electrical circuit means 53 to an LCD module 54 that has a 16 character by 2 line alphanumeric display.

A personal computer is represented by the block 55 in FIG. 8A and is adapted to be interconnected to a LONworks adapter 56 by electrical circuit means 57 with the LONworks adapter 56 being interconnected to the LONworks adapter module 28 by electrical circuit means 58 so as to permit the computer 55 to send information to the LONworks adapter module 28 and to receive information from the LONworks adapter module 28 as will be apparent hereinafter. In addition, additional network nodes represented by the block 59 in FIG. 8A is adapted to be interconnected to the LONworks adapter module 28 by the electrical circuit means 60 being interconnected to the electrical circuit means 58.

Also, a lap top computer is represented by the block 61 in FIG. 8A and is adapted to be interconnected to the LONworks adapter module 28 and the display module 25 by electrical circuit means 62 that are interconnected to the electrical circuit means 29.

The blocks 55, 56, 59 and 61 are indicated by dashed lines as the same could be part of the control system 20 of this invention or the control system 20 of this invention can be utilized without such computer interfacing if desired.

The LONworks adapter module 28 comprises a part 63 of the control system 20 and the LCD module 54 comprises a part 64 of the control system 20 as illustrated in FIG. 8A.

Since an LCD module 54 is well known in the art, no further detailed showing is provided in the drawings other than FIG. 8A.

However, the display control module 25 is set forth in detail in FIGS. 2A–2F with the various components thereof being respectively indicated by reference characters that are common in the art to represent the component, such as C for a capacitor, R for a resistor, D for a diode, Q for a transistor, etc. with each capital letter thus being followed by a numeric number to distinguish that particular reference letter from the others of a similar component. Therefore, only the components believed necessary to fully understand the various features of this invention in FIGS. 2A–2F will be hereinafter specifically mentioned with the understanding that since the other components not specifically mentioned and the electrical interconnections of the components are all elements that are well known in the art a specific explanation thereof to a person skilled in the art is not needed.

Similarly, the details of the power module 26 are illustrated in FIGS. 4A–4F except that the reference characters are followed by a prime mark to distinguish the electrical components from the electrical components of the display control module 25 and the LONworks adapter module 28.

Similarly, the LONworks adapter module 28 is illustrated in detail in FIGS. 6A–6F and the reference characters of the components thereof are followed by a double prime mark to distinguish the same from the display control module 25 and power module 26.

Unless otherwise specified in the drawings, all resistor values thereof are in ohms, 0.25 watt, plus/minus 5%, all capacitor values are 50 V, plus/minus 20% and all diodes are 1N4148.

Also each module 25, 26 and 28 has its own printed circuit board formed in a manner well known in the art to carry the components thereof and electrically interconnect the same together as illustrated.

Before describing the specific details of the system 20 of this invention, it is believed best to provide an overview of the unique cooking system provided by the control system 20 of this invention.

As illustrated in the drawings the control system 20 comprises a system that has three microprocessors U1, U1' and U1" (FIGS. 2A, 4A and 6A) that comprise a distributed microprocessor based system with the microprocessors being programmed in a manner well known in the art to operate in the manner hereinafter set forth.

As previously stated, the power module 26 has the microprocessor U1' which monitors inputs and provides outputs for magnetron circuits or means 22 in a microwave oven 21. There are three magnetrons in this system 20. The magnetrons are typically interfaced through a power transformer T'. This power transformer T' in turn has a half wave doubler circuit that rectifies the AC input and creates about 4,000 volts DC for the magnetrons. When the magnetrons have 4,000 volts across the anode to cathode thereof and if a filament voltage is present then the magnetrons will produce RF energy and thereby cook a product inside the microwave oven cavity. The power module 26 provides the timing sequences that are used for microwave oven cooking. In a microwave oven it is very common to apply power for specified times in order to cook a product. Therefore the power module 26 has a timer that can be programmed to provide this timed cook function. All of the monitoring functions of the magnetron means 22 are provided through the power module 26.

The display control module 25 comprises a means for entering data by a user that can be communicated over to the power module 26 block which in turn does the timing of the magnetron means 22 to provide cooking power. The display control module 25 comprises a keyboard interface 32 and 33, a vacuum fluorescent display 31 and an EEPROM memory device 30. The keyboards 32 and 33 provide a digipad and mode select keys that can be used to enter data into the microwave oven 21. This microwave oven 21 comprises a commercial microwave oven that has some preprogrammed recipes stored in the EEPROM 30. A typical operating sequence for the microwave oven 21 consists of menu selection, an item number and a quantity of the product being put into the oven. The function keys for the keyboards 32 and 33 consist of menu selection which is one of four menus. These menus are typically breakfast, lunch, dinner and prep. A typical sequence is to select an operating menu, for example it is the breakfast serving period of time. The next sequence of entering information is to select an item. In this parti-cular control system 20 there are two digits that display the item so item numbers will be from 1 to 99. The next step is to select the quantity of the product that is to be cooked. For example, it can be one hamburger or it can be up to nine hamburgers. As this information is entered, this information is sequentially displayed in the vacuum fluorescent display 31.

There are basically two types of microwave ovens that the control system 20 can implement. One is a low to midline control which consists of the display module 25 and the power module 26 as represented by the dashed line 24 in FIG. 8B.

The midline control system 24 consists of the display control module 25 and the power module 26 with a small amount of EEPROM 30. The EEPROM is used to store information for two menus and a quantity of ten item codes per menu. The control system 24 uses an algorithm to calculate the cook times for quantities that are entered. For example, if one entered an item 1, quantity 1, the information is accessed from the EEPROM and is communicated to the power module 26 to be executed thereby. If one entered a quantity 2 for that same item, then the display control module 25 will calculate the additional time that it should cook and then communicate that information to the power module 26 through the electrical circuit means 27. Additionally the user can access a special display mode and can enter cook times for all ten items in the two menu selections. This information then is stored permanently in the EEPROM 30 and can be used for perhaps a small grocery store or a small convenience store to program the most used products that are sold for cooking at the establishment.

Once the information is entered into the display control module 25 by selecting a menu, an item and a quantity, this information is then communicated to the power module 26 in the form of a time and power level. If there are multiple stages of cook that are associated with this product, this information is also communicated and so the power module 26 will be updated periodically with the cook time and the power level that the product is to be cooked. So the display control module 25 first will communicate stage 1 and the power module 26 will execute that stage and then as the power module 26 finishes that stage the power module 26 will request more information. That information for stage 2 will be communicated by the display control module 25 and be cooked by the power module 26. And so it is a sequential transmitting of these blocks of information from the display control module 25 and the power module 26 processes whatever the display module 25 communicates to the power module 26.

As previously stated, in prior known control systems the display control module and the power module were provided with one microprocessor. In the control system 24 two microprocessors U1 and U1' are used and are used with a serial communication protocol to communicate the information from the display control module 25 to the power module 26.

In this manner because the amount of large components that are mounted on the power module 26 prevented the power module 26 from being located in the front of the oven, the power module 26 is mounted in the back of the oven and the control user entry functions which needed to be a smaller panel is mounted at the front of the oven. So this was accomplished by using a distributed microprocessor based system. Typically the display control module 25 uses an 8 k microprocessor U1 with vacuum fluorescent drive capability. Other functions of microcomputer U1 include the ability to monitor a keyboard, interface to the EEPROM 30, interface to a speaker or audible, has the capability of a serial queue to send information to the power module 26, and provide the display control module 25 with other IO capability to interface to other outside control boards. The method to communicate information between the display control module 25 and the power module 26 is a serial communication protocol. This has four wires in the electrical circuit means 27 that are used. Typically these wires are named as a serial output from the display control module 25 and a serial input into the display control module 25, a clock line and another line which is called acknowledge or handshake. The power module 26 has corresponding serial in, serial out, clock and acknowledge or handshake lines. It was found that in order to communicate this information reliably between the two modules 25 and 26 an error checking method was needed. The method that was adopted is a calculation called a check-sum of the data that is being transmitted. Then a byte is communicated with the data. Then the receiving end will also do this check-sum calculation and compares it to the byte. If the two match, then the end will use that information. It should be understood that this system allows information to be communiated between the display control module 25 and the power module 26 in both directions and either unit can be the master and can initiate the transmission of data. For example, the display control module 25 after receiving all of the inputs from the user will store all of the timing that is needed to cook a product. That information then will be communicated in stages to the power module 26. The power module 26 in turn is really the time base or the clock for the system. The power module 26 uses the 60 or 50 hertz line to get a resolution of typically 30 or 25 counts per second. After every two line cycles the power module 26 sends a command across to the display control module 25 which will decrement the timer. After receiving thirty of these "ticks", the display control module 25 will decrement the displayed countdown sequence thereof by one second. And so in this way the two modules 25 and 26 are kept synchronized in their counting and monitoring of the cooking sequence.

The method that is used for this serial communication, the four line system, also has built into it the ability to recognize whether or not the receiving module correctly decoded the information that was communicated to it and this is done using the acknowledge line, which is programmed to provide a logic translation of low and then back high again at the end of the transmission. This acts like a flag back to the sending module that it received its information and it was properly decoded without errors. This is a very important feature of this control because in this environment the noise that can cause errors in transmission is quite susceptible. If one were to be required as in prior types of systems to send an acknowledgement back to the sending module, that information could also be corrupted and then both modules can become thoroughly confused. Thus, in the control system 20 of this invention,if the sending module does not see this logic translation on the acknowledge line of going from high to low and back to high, which is a very convenient and very fast method of acknowledging that the transmission was error free, then the sending module concludes that it must retransmit the information a second time. The power module 26, if it is the receiving end of this data, will simply get the information again. There will be no harm done because it is the same information duplicated. The advantage of doing this, in the case of the display control module 25 sending information across to the power module 26, is that the display control module 25 knows immediately whether or not the information that it had assembled in all of its storage buffers and so forth was received correctly. If it was not, the display control module 25 already has that information assembled to be communicated again. Thus the display control module 25 will keep sending the information until the display control module 25 sees this recognized signal from the receiving module. This is a real advantage because double storage of information is not needed. The sending module has many other tasks that need to be accomplished. Therefore, the sending module can then clear out the information that it had gathered, and proceed to do those other functions, and not be required to reassemble that information and send it again. Basically this works in both directions, whether it is the display control module 25 or the power module 26, and the module does not require additional memory to save the information. The information is initially retained in case it has to be sent again, and does not continue on in a sequence, unless the sending module knows that the other module has received that information.

In the case of the power module 26, the power module 26 also has the control over the power on resetting of the system 20. If AC power is disconnected from the system 20, the power module 26 will recognize this. The power module 26 will in turn, start shutting down many of the current or power using outputs, to conserve as much of the energy stored in the power supply capacitors thereof as possible. The power module 26 will also communicate to the display control module 25 that it should also shut down any other functions that are drawing power to achieve a low power usage mode of operation.

Initially when the power is first applied to the system 20, the power module 26 recognizes that power has just been applied and the power module 26 executes a power on reset sequence in the microprocessor U1', which assures that it is running properly. In the meantime it has a logic level that is also interfaced to the display control module 25, which keeps it in reset for a longer period of time, and then enables it to run after this time has elapsed. Therefore the power module 26 in the case of power on reset is the master of the system. This reset logic is also provided to other devices in the system if needed.

Another feature of the serial communication protocol is the reduction of the wiring required to transmit information between the display control module 25 and the power module 26. In a typical application these two modules 25 and 26 are separated by as much as three feet of wiring. If this was split with a parallel system it would take many wires, perhaps seventeen to twenty wires. With a serial communication protocol this is reduced to nine wires in the electrical circuit means 27. These wires consist of a serial clock, a serial out, a serial in, a handshake or acknowledge line, the –VFD which is for the vacuum fluorescent display, a ground wire, a 12 volt DC VDD wire, a start signal and a reset signal. Thus, the wiring is dramatically reduced and also the supervision of that information being communicated is reduced because there are fewer wires.

The midline control system 24 can be expanded to a higher line or highline control system 20 by adding the LONworks adapter module 28. This LONworks module 28 consists of a microprocessor U1" and the system thereof was developed by the Echelon Corp. The LONworks system is very similar to a modem or a local operating network which provides signals from the LONworks adapter 28 to many other nodes in a system. For example, this can provide an interface to a personal computer which can have additional information that can be accessed by the LONworks node or device 28. The LONworks module 28 is also used as an expanded memory for the display control module 25. The display control module 25 has an EEPROM 30 which can be used to store menus of ten items per menu. The LONworks adapter module 28 has a much larger flash memory and in this application the memory 52 is 32 k ×8 bytes of information. This flash memory 52 provides storage for up to 1,000 records, each record consisting of alphanumeric information as to the product to be cooked, an item code which is two digits, a quantity which is one digit and four stages of cooking information with each stage consisting of a power level and a time. These records are organized in such a way that the records can be divided up into a plurality of menus. These menus are typically a breakfast menu, a lunch menu, a dinner menu and a prep menu. Each menu can have up to ninety-nine items. Each item can be a quantity of one to nine. In this manner the records can be stored and categorized into menus, items and quantities and the information becomes like a table lookup. The main data that is stored in this memory is cooking times and power levels for the items. In this application then when the module 28 is used as an extended memory, the display control module 25 is programmed by a user who selects the menu, the item number and the quantity. This information is then requested through another communication bus of the electrical circuit means 29, which has the same protocol of a clock, a handshake line or acknowledge line and four parallel data bits. This protocol in turn will request information from the LONworks adapter module 28. The LONworks adapter module 28 will receive a block of information from the display control module 25 which requests information for a particular menu item and quantity record. This information then is looked up in the flash memory 52 and that information is then transmitted back to the display control module 25 which in turn communicates the cooking sequences to the power module 26 as previously described. The LONworks adapter module 28 also has an interface to the personal computer 55. This is accomplished through a product called an SLTA which is a serial LONtalk adapter 56 manufactured by the Echelon Corp. The PC interface is used for the function of storing and editing the information that is to be stored in the 32 k ×8 flash memory 52 in the LONworks adapter module 28. The typical method that has been developed is to edit and store this information using a common spread sheet program typically Lotus 1-2-3. The system 20 also has a data base program using Borland paradox to organize and store this same information. The spread sheet is organized such that it has columns and rows. Each row is a record and the columns are organized such that the first column comprises alphanumeric information about the product, such as its name. The next column comprises an item which is a two digit code. The next column comprises a one digit quantity and beyond that is timing information for stage 1 cook time and power level; stage 2 cook time and power level; stage 3 cook time and power level; and stage 4, cook time and power level. This information is entered into the spread sheet and a software utility is used to convert this block of data into a text file. This utility that converts this information into a text file also organizes it in such a way that it can be transmitted through the LONworks communication protocol to the LONworks adapter module 28 and that information is then reassembled and loaded into the flash memory 52 in a manner that can be used as a table lookup by the display control module 25.

The LONworks network and the PC interface can also be used as a means for updating the smaller 4 k by 8 EEPROM 30 in the display control module 25. This also is done through a text file that is transmitted from the PC 55 through the LONworks adapter 56 into the LONworks adapter module 28 and from the LONworks adapter module 28 into the display control module 25 which in turn loads it into the 4 k by 8 EEPROM 30.

It is believed that microwave ovens or commercial cooking appliances have never been interfaced as a network to a PC. Thus, with this ability to download information from a central point into several cooking devices, the control system 20 of this invention can be used in a typical fast food restaurant where the menus thereof are periodically changed. These menus can be developed by a corporate office home economist in the corporate kitchen, and this information in turn can either be sent by modem to the restaurants or it can be sent in the form of a small floppy disc. This information then can be loaded into the personal computer 55. The personal computer 55 then in turn can redistribute all the recipes to all of the devices that are on this operating network simultaneously. Another example of the advantages of a LONworks system is a large resort complex, where there are several kitchens. All of these kitchens can be connected by the network or by modems, whereby a chef that is responsible for the recipes can set up cooking instructions for specific items for use at a particular period of time. Perhaps it is a special for the day or perhaps it is something for a week or a month. It shall be understood that a chef at one location can program all of these cooking devices in that complex from one PC.

It is believed that the system 20 of this invention can be interfaced to order entry systems and that this system 20 can thereby automatically prompt people that are doing the cooking as to what has just been sold. For example, a customer at a fast food counter orders some specialty item and that information is then transmitted via a LONworks module to a personal computer or directly to the microwave ovens. In this way the ordered specialty sandwich and the information for that specialty sandwich is already preprogrammed by the PC 55 into the LONworks 32 k flash memory. The LONworks adapter module 28 also has an interface to the LCD module 54. Thus information that was developed by the order entry by coding in keys is transmitted via the LONworks 56 to the LONworks adapter module 28 whereby the information stored in program memory then prompts on the alphanumeric LC display module 54 the item that needs to be cooked. The operator is prompted to get the item and put it into the microwave oven. Next the operator presses the enter key, and the cooking information is automatically programmed for them. The operator is not required to enter the menu, the item code and the quantity. That information is already known by the system 20. Further this system 20 can have a queuing capability where several orders are communicated to this microwave oven. For example, the personal computer 55 or some other device in the system, even the LONworks adapter module 28, can recognize which items are to be cooked at a particular station, and then receive that information and put that information into a queue or a storage. Sometimes this queing is implemented as a first in, first out storage. Sometimes it is implemented as a first in, last out, and so forth for these types of memory storage implementations. In this case a user can have several items that are stored and the user can receive this information while the user is cooking one item, and the next item will pop up on the display. The system 20 can be programmed such that if the user is not able to cook that particular item at that particular time, the user can hit a key and skip it. The item then will go back into the memory stack, and can be programmed to eventually come back to the display again. So in this way the user will have a way of selecting the items that the user is capable of cooking at that particular period of time.

All of the information about the food that is cooked in the oven can also be sent back to the personal computer whereby this is a way of knowing how much product has been used during the day. If it is known how much product was cooked, this information can be used to adjust inventory, and thereby enables the ordering of items for the next day. A record of production is also a means of knowing how much product was sold versus how much product was cooked. In this way, an analysis can be made of how much cooked food had to be thrown away because the users overproduced the product. Thus a manager will control the work force to make sure that the work force produces efficiently and has good quality. One of the objectives of this is to make sure that the items are not served if they are not fresh, whereby the management now knows how much is being produced versus how much is being sold. In this regard, the management can begin to control the production rate. For example, if the management sees that the crowd is slacking off and the work force is still producing at a very fast rate, the management can instruct the work force in a timely manner to not produce any more product. This is a way of further adjusting the productivity of the restaurant as well as for quality purposes.

In addition to the system for entering data and executing the data through the power module 26, the power module 26 is capable of monitoring the AC line voltage and the AC line current to enhance the performance of the oven. The line voltage monitoring is used to select a voltage to operate the system 20 that is compatible to the commercial voltage supplied to the institution. Typically commercial line voltages are 240 volts AC or 208 volts AC which is typically a 3-phase system. In prior microwave oven controls the power circuits inside of the oven had straps and a technician could wire the main voltage to taps in the magnetron transformer circuit which is used to convert AC to the DC voltage as previously described. These taps are very cumbersome to use. Typically a microwave oven is delivered and the technician does not remember to adjust the correct voltage specified for the product.

To resolve this problem the system 20 of this invention has a method of monitoring the line voltage that is being serviced to the microwave oven. This is done by monitoring the secondary voltage on the control transformer, which is a high voltage to low voltage transformer, and typically is proportional to the primary voltage. The secondary voltage that is being developed with 240 volts applied to the microwave oven is typically 12 to 16 volts after it is rectified, depending on the nominal line. In the case of applying 208 volts as the main voltage this nominal voltage on the secondary after it is rectified is less than 12 volts. In the system 20, a differential amplifier is used to perform a voltage translation and compare the voltage on the rectified secondary of the control transformer to a signal that is scaled from 0 to 5 volts for an input voltage of between 160 and 260 volts. Thus the 0 to 5 volts is divided up by an A to D converter into an 8 bit code which is 256 steps, such that the voltage resolution is about a volt per step or some fraction thereof. Thus when the power is first applied to the microwave oven 21, the system 20 is programmed to read the voltage that is on the secondary of this power supply after the voltage has been rectified. The system 20 does this before any other circuitry of the system is turned on to minimize loading effects on this power supply voltage. The EEPROM 30 of the display control module 25 stores values that correspond to these line voltages. In fact this system 20 is calibrated for the point that the high to low voltage is detected and discriminated. For example the lowest line voltage for the 208 input that can be applied to the microwave oven 21 is programmed in the system 20 so as to remember the A to D conversion code that would be the equivalent of applying that voltage. In turn the lowest line voltage for the 240 volt input is also programmed to be remembered. Therefore when the oven is first turned on, the system will test to determine if the voltage is in a low voltage band or a high voltage band, whereby these limits are programmed into the EEPROM 30 as to where that threshold will occur. It is also believed that this method can also be used for a brownout condition. For example the oven can be operating off a 240 volt line that has a lower voltage than one would prefer and in this case the microprocessor based control can elect to boost that voltage by switching the line voltage into the lower voltage tap to increase the turns ratio to the magnetron DC power supply.

The line current sensing means of the control system 20 is somewhat similar to the voltage sensing except that a wire from the main is passed through a current transformer. This current transformer is used to convert the magnetic flux from the AC current passing through the wire into a small AC voltage signal. This AC signal in turn is interfaced to a differential amplifier which amplifies it and scales it such that from 0 to 30 amps of current in the wire passing through the hole in the current transformer will generate a corresponding peak signal. This signal is like a rectified but unfiltered AC signal. The peak of the signal is scaled to be a maximum of 5 volts DC after amplification, when the AC line current is greater than 30 amps. In this way the peaks of the AC current can be converted by an A to D converter which is scaled into an 8 bit code or 256 steps from 0 to 5 volts. In this way the resolution of the steps is a factor of 30 amps divided by 256. The current sensing means of the A to D converter is very fast. Therefore the A to D converter can take several samples of the AC current, which is 60 hertz sinusoidal, and thereby the A to D converter can actually find the highest reading on that sinusoidal wave form. Thus, by taking several readings near the crest of the AC sinusoidal signal it can determine what the peak current is. This peak current then is used to detect several functions within the microwave oven. One function that it detects is the amount of current drawn by the appliance when one, two or three magnetrons are turned on. In a typical application, the magnetrons are turned on sequentially but with only a couple of line cycles between the firing of each magnetron. It is typical in a microwave oven to turn on the magnetron circuit at 90° of the AC line to minimize the amount of in rush current that can flow from the main into the primary of the magnetron transformer. In a magnetron circuit if the filament is not initially energized, it takes time for the tube to start conducting. The filament must first warm up. Typically it requires about 1-½ seconds for this to occur. Meantime the current to the magnetron is at a minimum, and as the filament starts to heat up after about a second and a half, the current through the magnetron will begin to increase and this increase is somewhat exponential. The wave form that the current transformer is monitoring is still sinusoidal, whereby the peak amplitude of the sinusoidal wave form will increase with each successive cycle of the AC line. It takes perhaps a quarter of a second for the magnetron once it starts to conduct to get to its full on conduction. The A to D converter of the system 20 of this invention is capable of detecting the peak of each AC sinusoidal wave of the power supply. In this way the microprocessor U1' is capable of tracking the increasing peaks of these waves and as the peaks increase the microprocessor U1' can determine when the tube is in full conduction.

Another aspect of this system 20 is that system 20 provides feedback as to how long it takes for a magnetron tube to actually warm up and start conducting. This is important because in many other magnetron microwave oven control systems the filament of the magnetron is always energized and therefore when power is applied to the primary of the magnetron transformer, it does not take a long period of time, possibly a couple of line cycles, to actually develop the 4,000 volts to make the tube conduct and this is what is called an instant start magnetron oven system. These systems have been used for many years and the cooking algorithms have been developed to cook certain product. Therefore if a time of ten seconds is programmed to cook a product with an instant on system, the amount of cooking power that is delivered into the product is the full ten seconds. However in a system whereby the filament is not energized until a power is applied to the primary of the magnetron circuit, it takes a second and a half to two seconds for this filament to warm up and start conducting in the tube. One method that has been used to compensate for this delay time is to factor in a delay of the countdown of the cooking time by a fixed amount, such as 1.5 seconds, and then start the cooking. However, as a magnetron circuit in its environment ages, it might take longer than 1.5 seconds for the filament to warm up, and so an error is induced into the system for the cooking time. This can affect the cooking in an adverse manner in that it becomes undercooked.

Another adverse effect is the condition of a line voltage that is higher than normal. In this case, the filament in the magnetron circuit can heat up and start conducting in the magnetron faster than 1.5 seconds and therefore the error is in the positive sense that more cooking power is applied to the food item which might damage the product by overcooking it. So it is desirable to know more precisely when the magnetron starts to conduct and at that point to start the cook time. With the technique of determining when the magnetron starts to conduct power, the result will be that the cooking time is very similar to the cooking time for an instant start microwave oven system. It has been determined that many microwave ovens with instant start have been sold to the commercial food processing industry. In many instances these have been programmed or have had cooking algorithms established for them for particular products. Therefore if they are instant on and a certain time period is entered into the control to cook the product, one will get a certain result. However, in the case of putting that certain time period into a control that has a cold start feature, then the results might not be as consistent. Therefore it is a very desirable feature to make the two types of microwave ovens compatible to cooking algorithms that already been established.

Another aspect of using the current sensing or current transformer of the system 20 of this invention is to monitor the current that is flowing into the microwave oven circuit when either one, two or three magnetrons are energized. In this way the system 20 can detect if a magnetron malfunctions and does not produce any microwave energy. A typical failure mode for a magnetron is to stop conducting. Usually the filament will burn out in these devices or the filament might age to the point that the magentron no longer can conduct. The magnetrons are very similar to a fluorescent light that has a life and as that life increases the tube gets weaker and weaker. The system 20 of this invention can detect weak tubes that have failed. This is an important feature because in the food processing industry it is important that all the product gets cooked properly, and with the correct elevation of the product to a specified temperature, which is used to kill bacteria or other harmful health considerations that can be avoided. If the product is not using the correct amount of energy, then the device can be taken out of operation or a warning can be sounded, such that the cooking time is adjusted to bring it back to that proper cooked temperature. Thus, this is a very important aspect in being able to monitor the functionality of a microwave oven.

Other inputs into the power module 26 that are used for monitoring purposes comprise an inlet temperature which is detected by a thermistor and an exhaust temperature which is also detected by a thermistor. These thermistors are placed in the respective parts of the vent of the microwave oven to monitor the temperature difference between the air coming into the appliance fan system and the air temperature being exhausted. This information is used by the system 20 to control the elevated ambient within the microwave oven. This is used as a reliability monitoring to prevent the system 20 from being used to the point that it becomes overheated. If this condition is detected the system 20 can take evasive action and either shut the system 20 down if there is a safety consideration or simply display some sort of a warning, so the user can let it cool down a little bit, before resuming its operation. For examaple, in some cases in the fast food industry, an operator may think that the appliance is broken when really it is being abused. In this case it is desirable to disallow use for a few minutes and let the appliance cool down, rather than have it fail catastrophically, which would result in not being able to produce anything. So it would be better to make sure that the equipment is reliable and performs well rather than allow abuse that can lead to failures. System 20 accomplishes this with a control circuit, to be described later, which has a differential amplifier that monitors both of the aforementioned temperatures. This circuit converts the differential voltage into a voltage that is between 0 and 5 volts and uses an 8 bit A to D conversion in the microprocessor U1' to give a scale of how much temperature difference there is between the input air duct and the output air duct of the microwave oven. Because there are three magnetron tubes there is a lot of energy being used and it is very desirable to monitor the ambient temperature inside the microwave oven.

A door status switch is also monitored by the power module 26. This particular switch is used to stop the magnetrons when the door is opened. This contact is staged such that when the latch of the microwave oven is first lifted and before the door opens, the contact is sensed and the system 20 immediately shuts down the magnetrons before radiation energy can escape from the oven door seal. The door status signal also starts a fan in the system 20 that is used for the cooling, and a stirrer motor that is used to mix the RF energy inside the oven cavity.

There is also a monitoring of temperature cutouts or TCO's by the system 20 of this invention. TCO's are overtemperature disc limits that are mounted on the magnetrons. These are wired in series, whereby if any one of the three magnetrons develops an overtemp condition, a logic signal is provided, and that will cause the oven to shut down.

The system 20 also has a flame detector that comprises an optical photo transistor. The photo transistor is placed such that it monitors the ambient light inside the oven cavity. Typically a commercial microwave oven does not have a window, whereby it is dark inside the oven cavity. The flame detector is also used to detect arcing and sparking within the microwave oven. Any light that occurs, even if it occurs for an instant, such as a flash, is detected by this flame detector. The flame detector signal is also interfaced through a differential input amplifier and is scaled so that the amount of light that the photo transistor measures is converted to 0 to 5 volts. The shape of this wave form is analyzed by the microprocessor U1' to determine the light condition inside the microwave oven.

The specific details of the system 20 for performing the aforementioned operation of the microwave oven 21 will now be described.

The power board or printed circuit board of the power module 26 is set forth in FIGS. 4A–F and has a power supply which generates DC voltages. The input to the power supply is a transformer T1', FIG. 4A, that has two primary coils which are in series and allows a 240 volt AC input. The transformer T1' has a secondary which is used as a center tap winding and in turn has diodes D1', D2', D3' and D4' that are interfaced thereto. Diodes D1' and D3' are used as a full wave rectified power supply to develop the power supply voltage VDD which is the equivalent of nominally 12 volts DC. Diodes D2' and D4' are also used as a full wave rectifier and develop the power supply voltage VR, meaning voltage for relays. VR also is a nominal 12 volt DC power supply. Thus both voltages VDD and VR are the same voltage amplitude but interface to different parts of the circuit. This is done for isolation, in particular to provide a supply VDD which has very low ripple and a supply VR which can tolerate greater ripple that can be interfaced to the relays.

The power supply voltage VDD is a voltage of 12 volts from the VDD label to a common ground. The 12 volt VDD supply is interfaced from a filter capacitor C3' which is a 1000 microfarad electrolytic capacitor. From capacitor C3' the VDD is interfaced through a dropping resistor R1' of about 18 ohms and goes into a second filter capacitor C22' which is a 47 microfarad electrolytic capacitor. The second capacitor C22' provides additional ripple filtering and is provided mainly to give better noise immunity for transient suppression. The voltage that is capacitor C22' is interfaced in series to the transistor Q1' which is a pass transistor for a step down linear regulated power supply. A resistor R2' supplies a bias current and voltage to a zener diode Z1' which in turn is interfaced in series with the base emitter junction of a transistor Q3'. These two voltages, the Q3' base emitter and Z1' voltage form a voltage at the base of the transistor Q1' which in turn provides a regulated voltage at the emitter of the transistor Q1'. This regulated voltage is labeled VCC and is nominally 5 volts DC. The 5 volts DC in turn is supplied to the microprocessor on pin 16, also labeled VCC, of the integrated circuit microprocessor U1'.

A filter capacitor C6' also interfaces in parallel with VCC to ground and is tied to VCC pin U1'-16 to ground which is microprocessor pin U1'-11. This filter capacitor C6' is for high frequency decoupling of noise.

The power supply regulator also has integrated into it a power on reset circuit. The power on reset circuit is made up of transistors Q3', Q2' and other resistors and capacitors that are associated with it.

As the voltage at the capacitor C22' increases and approaches the voltage of the zener diode Z1' and the base emitter of the transistor Q3', current will begin to flow through the resistor R2', through the zener diode Z1' and into the base emitter of the transistor Q3'. So as the voltage at the base of the transistor Q1' approaches the regulator voltage then the transistor Q3' is turned on by the current that flows through the zener diode Z1' into the base emitter of the transistor Q3' When the transistor Q3' turns on it will also turn on the transistor Q2' which provides a one level at the reset input pin 18 of microprocessor U1'. Normally when the voltage is not sufficient to provide a regulated output on the emitter of the transistor Q1', the transistor Q3' is turned off and the transistor Q2' is also turned off and a zero logic level is applied to the reset input 18 of the microprocessor U1'.

Resistors R4' and R5' are simply resistors for establishing bias currents for the transistors and particularly the resistor R4' is used to turn off the transistor Q2' and the resistor R5' is the base limiting resistor to turn on the transistor Q2'. Resistors R6' and R7' in combination with a capacitor C7' is an RC network which is used to shape the wave form of the reset pulse going into microprocessor reset pin U1'-18. This is used to slow down the wave form both in a turn on and a turn off rise and fall times.

The power supply circuit of the power module 26 also has a negative power supply voltage which is labeled −VFD. This voltage is developed by a half-wave double circuit which consists of a capacitor C4' in combination with a diode D6'. The positive side of the capacitor C4' ties to the transformer T1' AC output and the negative side of the capacitor C4' is interfaced through a diode to D5' to ground. As the voltage of the transformer T1' goes positive with respect to ground, the capacitor C4' is charged plus to minus with respect to ground. As the voltage of the transformer T1 goes negative with respect to ground the positive input of the positive side of the capacitor C4' is driven below ground and the voltage that is stored across the capacitor C4' is then interfaced through the diode D6' and its current then flows into the capacitor C5' which has its positive terminal interfaced to ground and its negative terminal interfaced to the diode D6'. In this way a −24 volts DC is established across the capacitor C5'.

A resistor R8' is a current limiting resistor and it also drops a little bit of voltage across it as current is interfaced into the circuit supplied by the power supply voltage −VFD.

As illustrated in FIG. 4C the microprocessor U1' also has a 60 hertz clock interface which is on pin U1'-23. This 60 hertz signal is developed from the AC line and is interfaced through the transformer T1'. The secondary of the transformer T1' has its AC voltage interfaced to a resistor R14' which is in seres with a capacitor C9' which is a 0.1 microfarad capacitor and is also interfaced to ground. This is an RC network which is used to decouple any high frequency noise that might have passed through the power supply. As the 60 hertz AC wave form developed from the transformer T1' flows through the resistor R14' in the positive direction it will also provide current through a resistor R15' and into the base emitter of a transistor Q4'. As this voltage is positive and provides a positive current it turns on the transistor Q4'.

A diode D7' is a reverse bias diode such that when the secondary voltage of the transformer T1' goes negative with respect to ground then negative current will flow through a resistor R14' through a resistor R15' and through the forward biased diode D7'. This provides a −0.6 volt bias across the base emitter of a transistor Q4' base and turns off the transistor Q4'. Thus the transistor Q4' turns on when the secondary of the transformer T1' is positive and it turns off when the secondary voltage of the transformer T1' is negative. As the transistor Q4' turns on and off, the transistor Q4' is biased by a pull-up resistor R16' at the collector. The resistor R16' in turn provides a bias voltage of either 5 volts or if the transistor Q4' is turned on it will be approaching 0 volts. This is interfaced through a resistor R17' into the microprocessor input U1'-23 which is the 60 hertz clock. The microprocessor U1' in turn uses this 60 hertz square wave as a time keeping device and it also uses this information to detect zero cross of the AC line. This in turn is used for crest firing or firing the magnetron output circuits or other energy power devices with respect to the AC line at a phase angle which is a desirable phase angle to be discussed later.

The microprocessor U1' also has an oscillator circuit as illustrated in FIG. 4C which consists of a crystal and this is represented on the schematic by the designation Y1'. The oscillator input pins of the microprocessor U1' are U1'-9 and U1'-10. This is typically a ceramic resonator and has a nominal frequency of 4 megahertz. The microprocessor U1' uses this oscillator as its main system clock and all internal subsequent timings are based on the frequency that is generated by this oscillator.

Figure 10B:
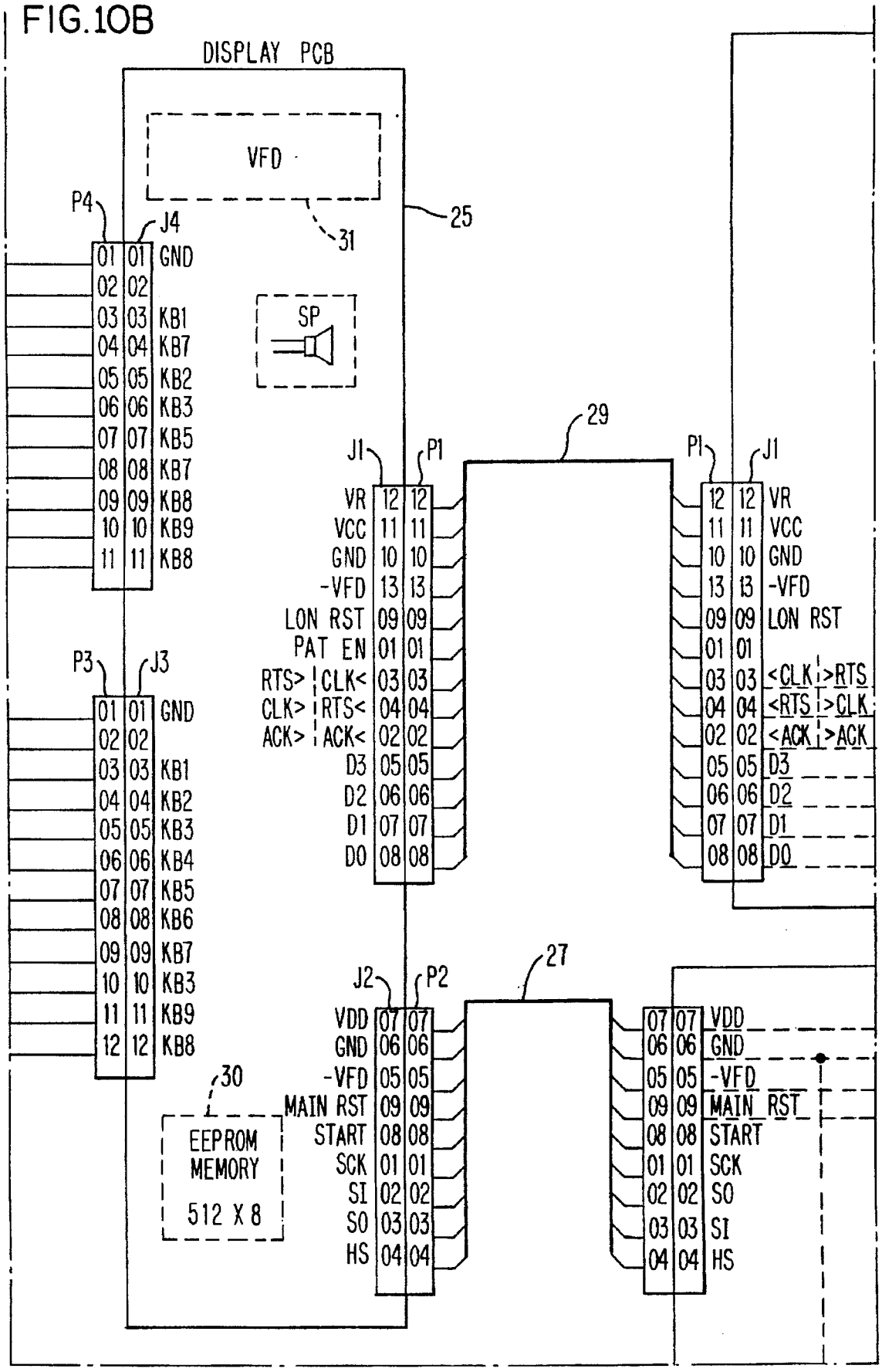
Figure 10C:
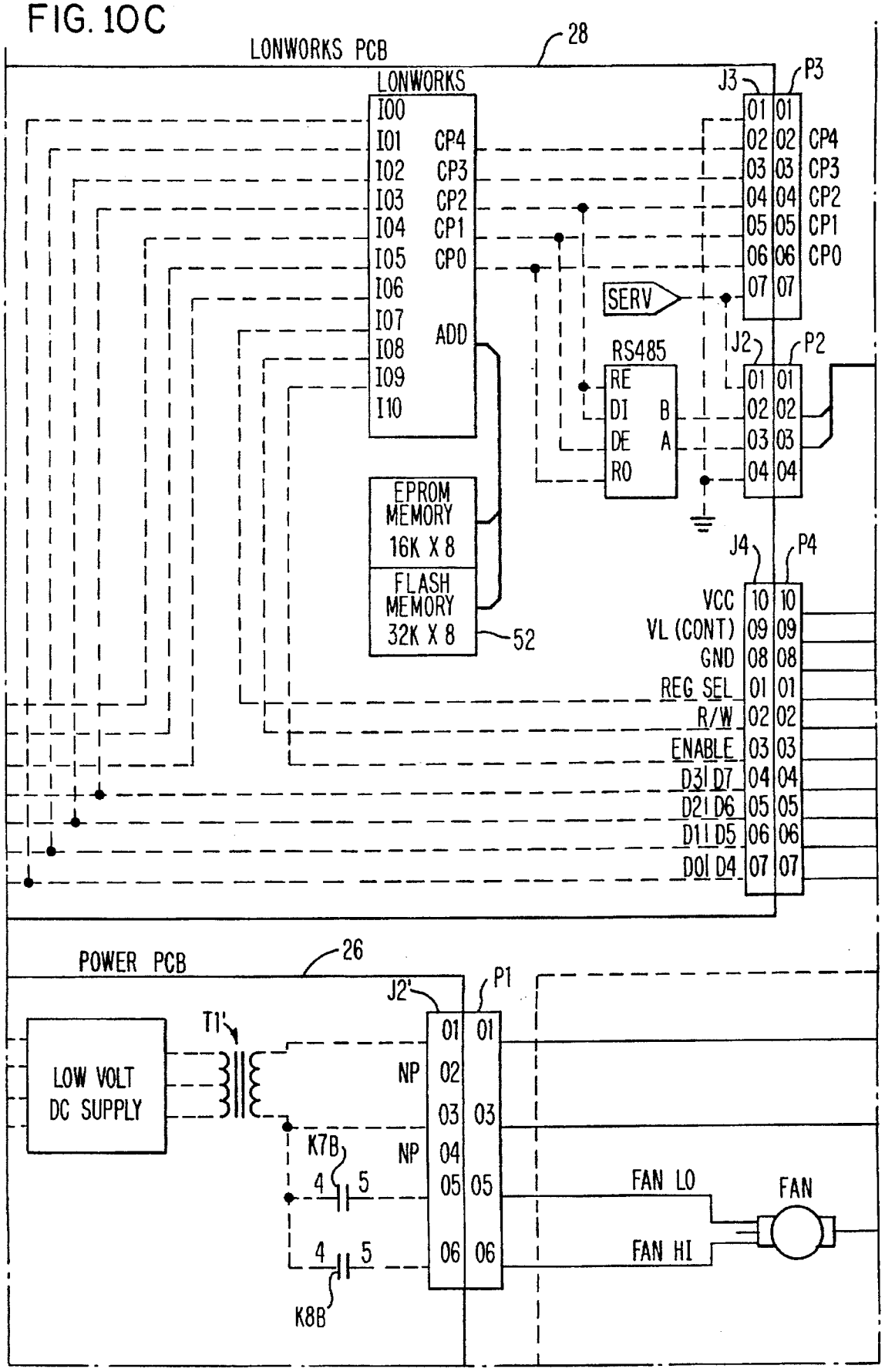
Figure 10D:
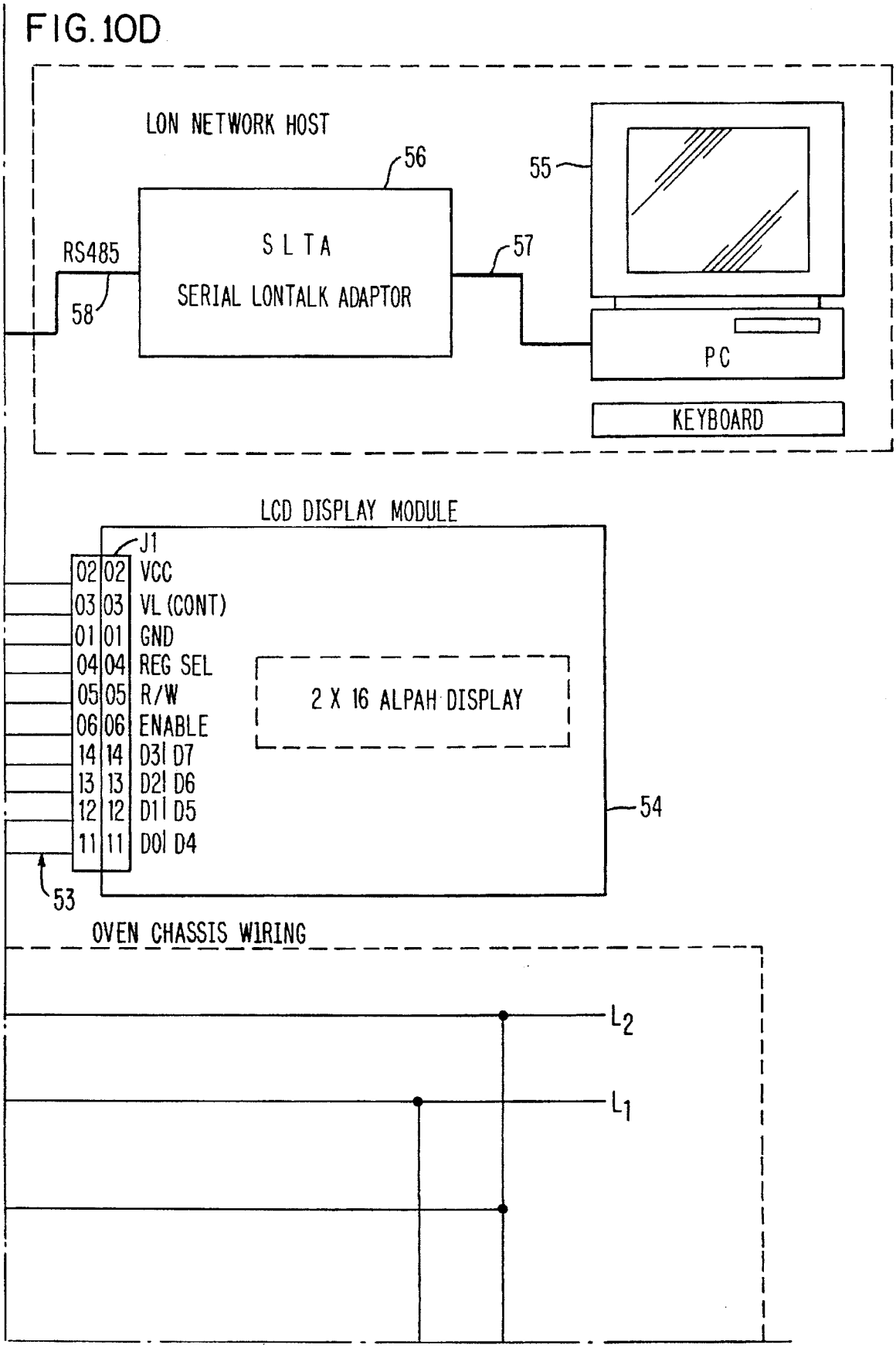
Figure 10E:
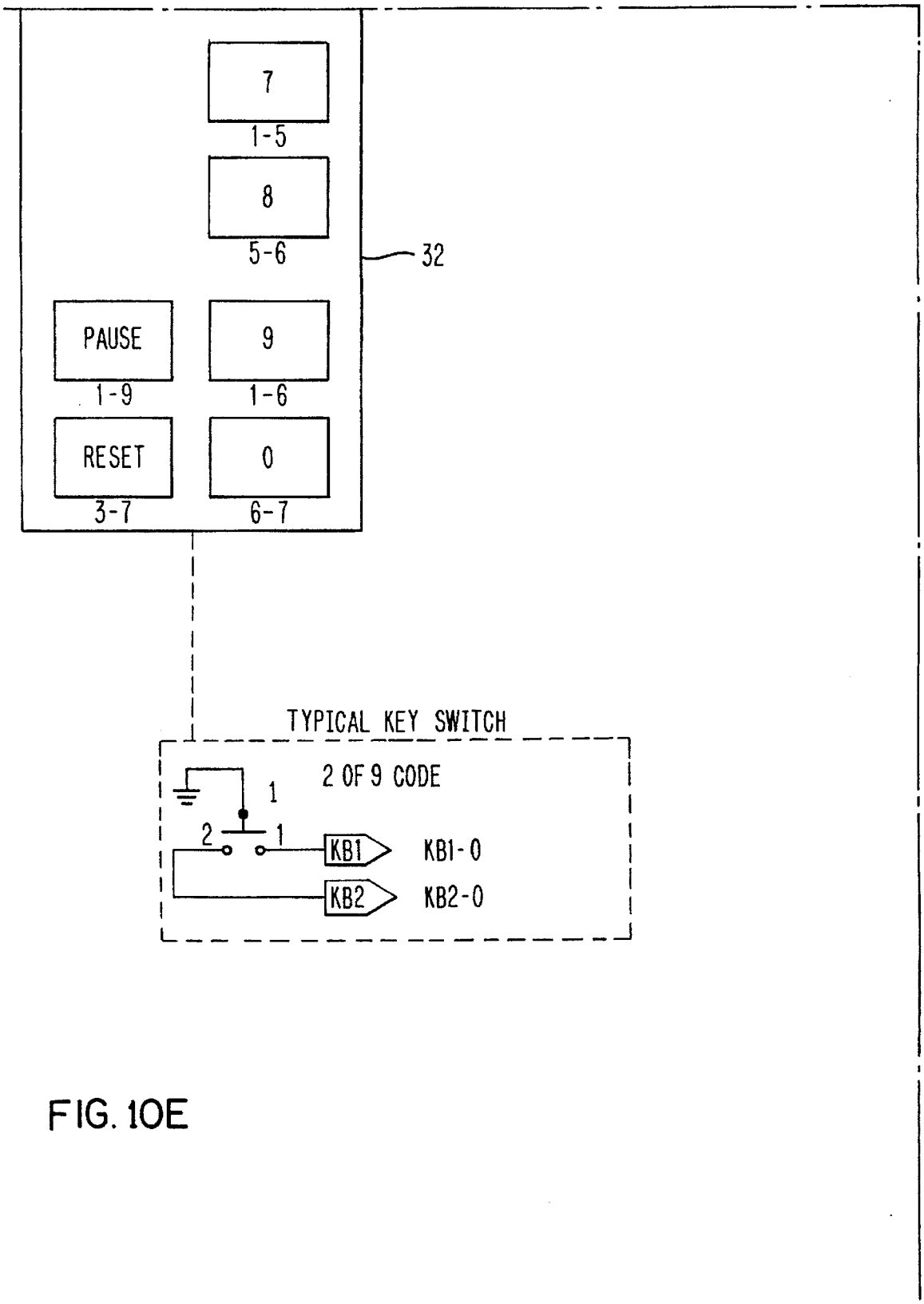

One of the features of the control system 20 is to provide a means for measuring the line voltage and for energizing the relays which will supply the line voltage to one of two taps on the magnetron power transformer T'. These two taps as illustrated in FIGS. 4F, 10G and 10H are such that if the high tap indicated as HI VAC is used then the high voltage applied to the magnetron transformer T' such as 240 volts AC will supply an appropriate secondary voltage for the magnetrons of about 4000 volts. If the low tap indicated as LO VAC of the transformer T' is selected then the step-up ratio of the transformer T' will be changed such that a nominal 208 volts AC will provide this same nominal magnetron voltage of approximately 4000 volts. To determine what line voltage is being supplied by L1 and L2, a circuit is provided in the control system 20 that will measure the ratio of the unregulated power supply with respect to a regulated power supply which in this case is 5 volts or the voltage that is labeled VCC. The VCC is developed by the regulator which was previously described. This circuit is illustrated in FIG. 4A and comprises a differential amplifier which is labeled U2A'. The negative input of the amplifier U2A' is interfaced to the VCC or 5 volts and has a gain setting for this leg which is set by resistors R9' and R10'. The other or positive input to the differential amplifier U2A' is interfaced to the unregulated power supply voltage VDD and it has a pair of gain resistors R11' and R12'. The gain of the differential amplifier U2A' is calculated by a means that is known to one that is skilled in the art. The gain of the differential amplifier U2A' has been set such that the differential voltage between the VCC reference and VDD is a ratio of the AC line voltage. It has been set such that when the AC line voltage is a nominal voltage of 160 volts, the differential amplifier U2A' has an output of near 0 volts. This differential amplifier output is noted on the schematic as U2A'-1. When the AC line is approximately 260 volts then the differential amplifier U2A' has an output of about 5 volts. In this way as the AC line varies between 160 volts and 260 volts the output of the differential amplifier U2A' will be between 0 and 5 volts. Now these are just nominal numbers and other values could be selected such that the ratio could give a span of 100 to 300 volts and still give an output voltage of 0 to 5 volts.

The output of the differential amplifier U2A' which is 0 to 5 volts is interfaced to the microprocessor U1' on an A to D input channel and this is U1'-12 and this is through a series resistance R13' which is merely a current limiting device. As the AC voltage varies between 160 and 260 volts the microprocessor U1' in turn monitors the corresponding 0 to 5 volt output of the differential amplifier U2A' and converts this information into a digital quantity which is an 8 bit binary number. Thus the microprocessor U1' can resolve the difference in AC voltage by a scale factor of 8 bits or 1 out of 256 counts.

The microprocessor U1' also has an interface to an EEPROM type memory which has threshold voltages established for high voltage versus low voltage. These threshold voltages are stored by factory personnel to give set points that can be used to either apply the line voltage to the low voltage tap of the magnetron transformer T' or to the high voltage tap of the magnetron transformer T'. Typically a voltage that is less than 220 volts is considered to be low voltage and a voltage that is greater than 220 volts is considered to be a high voltage: Correspondingly the line voltage is applied to the appropriate high voltage or low voltage tap to develop a magnetron secondary voltage that is more of a constant and provides a constant cooking power for the microwave oven 21.

The power board or module 26 also has an interface to a current transformer T2', FIGS. 4C and 10G, which monitors the current that is being supplied by the line 100 into the magnetron power circuits 36. This current transformer T2' is a transformer which has a secondary winding 101. The secondary winding 100 has a hole 102 through the center of the transformer through which the line cord 100 is inserted. The line cord 100 in turn becomes the primary of the current transformer T2'. As AC current is passed through the power cord 100, the power wire 100 that goes to the center of the current transformer T2', the secondary 101 will give a corresponding small voltage AC wave form. This AC wave form is interfaced into a differential amplifier U2B' and the negative input thereof is U2B'-6 and the positive input thereof is U2B'-5. The negative input U2B'-6 to the differential amplifier U2B' has a gain selection which is set by an input resistor R24' of the voltage gain network and a feedback resistor network comprising resistors R26', R27' and R28'. The resistors R26', R27' and R28' comprise a T type feedback network that uses low impedance resistors to provide an equivalent high impedance in a manner that also is well known to those skilled in the art. The gain for the positive input of the differential amplifier U2B' is controlled by resistors R25' and R29'. The current transformer T2' also is referenced to ground through resistors R22' and R23'. A resistor R21' is also put in parallel with the current transformer T2' and is used to convert the current from the windings of the transformer into a small AC type of voltage. The current transformer T2' interfaces this AC wave form, which is a significantly small amount of voltage, into the differential amplifier U2B'. The differential amplifier U2B' in turn rectifies that AC wave form and provides a half-wave rectified signal which has an amplitude that appears to be sinusoidal similar to the AC wave form 60 hertz. It has a peak amplitude of approximately 5 volts when the current through the line cord wire 100 approaches greater than 30 amps. In this way the gain of the differential amplifier U2B' and the interface through the current transformer T2' has a scale factor of between 0 and 30 amps that provides a half-wave rectified pulse of approximately 0 to 5 volts. The output of the differential amplifier U2B'-7 is interfaced to the input of an A to D channel U1'-13 of the microprocessor U1' through a resistor R30' which is a current limiting resistor. The microprocessor U1' in turn has an internal 8 bit A to D converter channel similar to the line voltage channel that was described earlier. It has the capability of resolving the 0 to 5 volt input signal into an 8 bit binary number which has a resolution of 1 out of 256 steps. In this way, the current that is flowing in the line cord 100 can be resolved by the microprocessor U1'. This in turn is used by the software of the microprocessor U1' to determine if the magnetron circuits are functioning normally. It is also used to check the amount of current flowing through each magnetron. The nominal current that will flow through a magnetron that is capable of 750 watts of output power is approximately 10 amps when it is turned on full. Thus, the microprocessor U1' through other logic turns on a particular magnetron and checks to see if 10 amps is flowing. In this way the microprocessor U1' knows that the magnetron circuit is conducting properly. Secondly the microprocessor U1' turns on an additional magnetron and checks to see if the current increases an additional 10 amps from 10 amps to 20 amps. Additionally the microprocessor U1' turns on the third magnetron and checks to see if the current increased from 20 amps to 30 amps. In this way the microprocessor U1' will know and be able to supervise that the magnetrons are really providing energy and are in a conducting state.

The current transformer T2' is also used to detect when a magnetron circuit is conducting power during its warmup stage. It is typical for a magnetron circuit which has a filament voltage to take approximately one second to warm up the filament and thereby have the tube start to conduct. It is desirable to determine when the tube goes into conduction because this is the start of the applying of energy into the product that is being cooked. Therefore the microprocessor U1' monitors the peak amplitude of the current transformer T2' and subsequent output U2B'-7 of the differential amplifier U2B' to determine when the peak amplitude increases rapidly from a low state of near 0 amps to a full on state of near one-third of 5 volts per magnetron. In other words as a magnetron starts to conduct, the current of the line increases approximately one-third of the VCC voltage. The microprocessor U1' detects this current step of change and thereby knows how long it takes for the magnetron filament voltage to warm up sufficiently for the magnetron to start conduction. This feature is desirable because the cook times can be executed based on when the magnetrons start to conduct. Thus knowing the warmup time a delay or a hold or a pause in the timer is implemented by the microprocessor U1' such that the cook time does not decrement during this warmup time and when the magnetron tubes start to conduct then the cook time is initiated. Thus the cook time is primarily decremented when the magnetrons are conducting energy into the product. It is typical in a microwave oven that has a warmup time for this warmup time to vary with the age of the magnetron tube. As the tube gets older it takes longer for the magnetron to start conducting. Therefore if a constant warmup time was used and was applied to the cooking algorithm, the amount of time that it will take to warm up could vary and the cook time will not be accurate. Knowing the amount of time that it takes for the magnetron to warm up and starting the time when it is warmed up removes this error from the cooking algorithm. In this manner the magnetron circuit and the energy will be very consistent over the life of the product.

The power board or power module 26 also is used to monitor the temperature of the air flow through the cooling system of the magnetrons. This is accomplished by two thermistors RT-1 and RT-2, FIG. 10F. One thermistor RT-2 is installed in the intake air vents of the microwave oven 21 and the second thermistor RT-1 is installed in the exhaust vent of the microwave oven 21. As the magnetrons are energized they create heat and they are cooled by the cooling fan which takes intake air from the room and blows it through the vents and through the magnetron cooling heat sinks to be exhausted out through the exhaust port. The power board 26 has a differential amplifier U2C', FIG. 4E, which is interfaced to these two thermistors and this is through connector J1'-2 and connector J1'-3 as illustrated in FIG. 4E. The thermistors are interfaced with one side of both thermistors tied to ground and the other side of the thermistors respectively are tied through resistors R31' and R32' to the power supply voltage 5 volts DC or VCC as illus trated in FIG. 4C. The thermistor RT-2, which is on the intake of the cooling fan, is interfaced to the positive input U2C'-10 of the differential amplifier U2C' through resistors R34' and R35' which are gain establishing resistors. The exhaust temperature thermistor RT-1 is interfaced to the negative input U2C'-9 of the differential amplifier U2C' and has gain establishing resistors R33' and R36'. Typically the intake thermistor RT-2 which is interfaced on J1-3 will have a higher impedance and therefore a higher voltage divider feeding into the positive input U2C'-10 of the differential ampli-fier U2C'. The exhaust thermistor RT-1 will have a lower resistance and thereby have a lower voltage feeding into the minus input U2C'-9 of the differential amplifier U2C. The gain for the differential amplifier U2C' is established by the resistors as previously described such that the temperature differential between a cool oven and a hot oven provides an output voltage on the output port U2C'-8 of the differential amplifier U2C' of between 0 and 5 volts for the extreme magnitudes. The output U2C'-8 of the differential amplifier U2C' is interfaced to the microprocessor U1' through a resistor R37' into an A to D input channel or port U1'-14 which also is an 8 bit A to D converter and will provide a scale factor of 1 to 256 for an input voltage of 0 to 5 volts. So in this manner as the temperature differential between the input thermistor of the microwave oven 21 and the exhaust thermistor of the microwave oven 21 begins to change in a direction that indicates a positive thermal differential across the oven, the microprocessor U1' in turn monitors this differential temperature change and turns off the oven when the temperature exceeds a preset value which can be stored in the EEPROM 30 of the system. This preset value is programmed at the factory and is a safe operating temperature for the microwave oven. When conditions are such that this operating temperature is exceeded, the microwave oven 21 is shut off and in turn displayed information is provided back to the user to indicate that the oven is over temperature and it needs to cool down. The intent of this feature is such that the microwave oven 21 can inform the user when something has either failed or if the oven is being used in an ambient or other operating conditions that cause overheating.

Figure 10F:
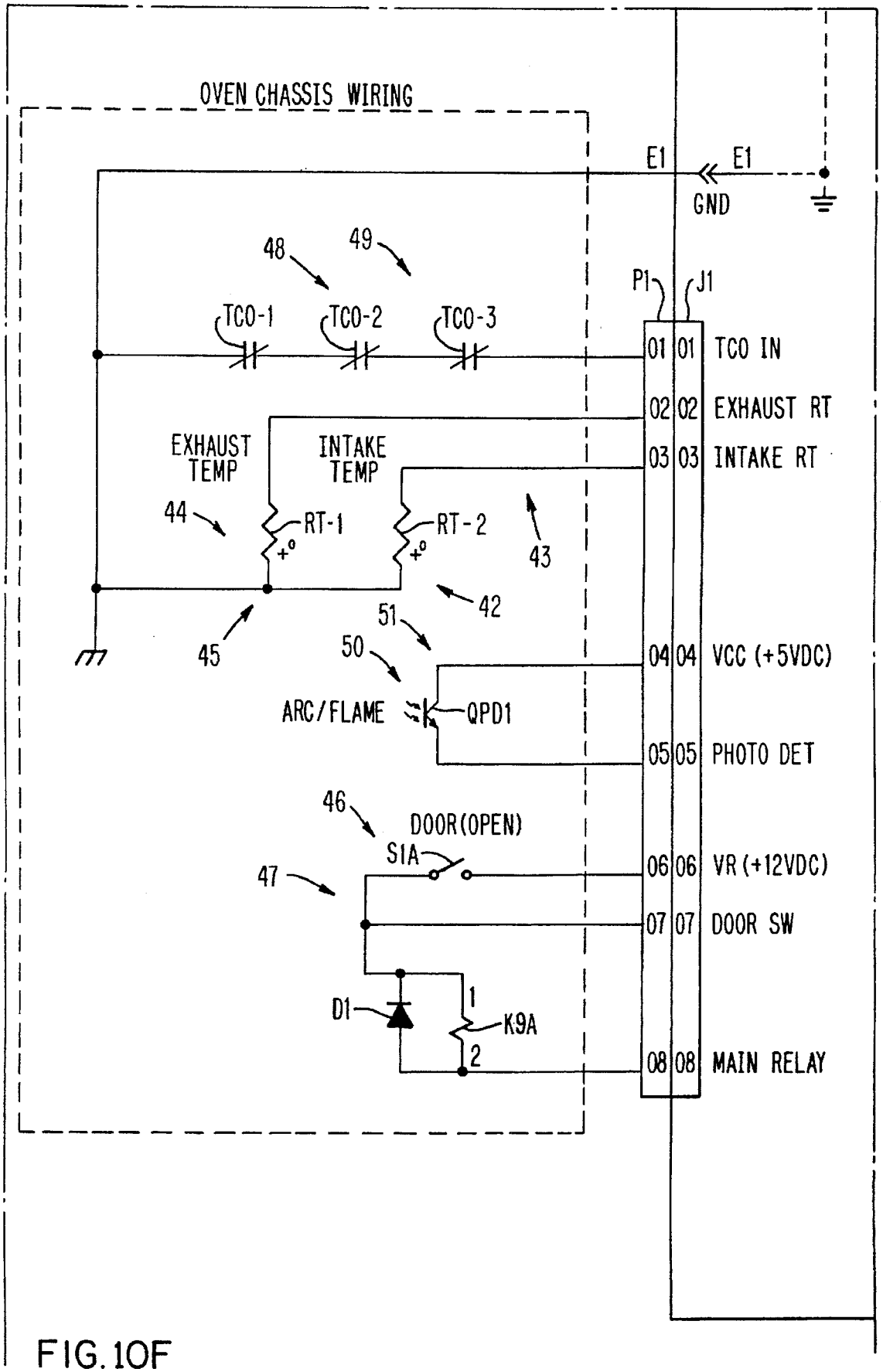
Figure 10G:
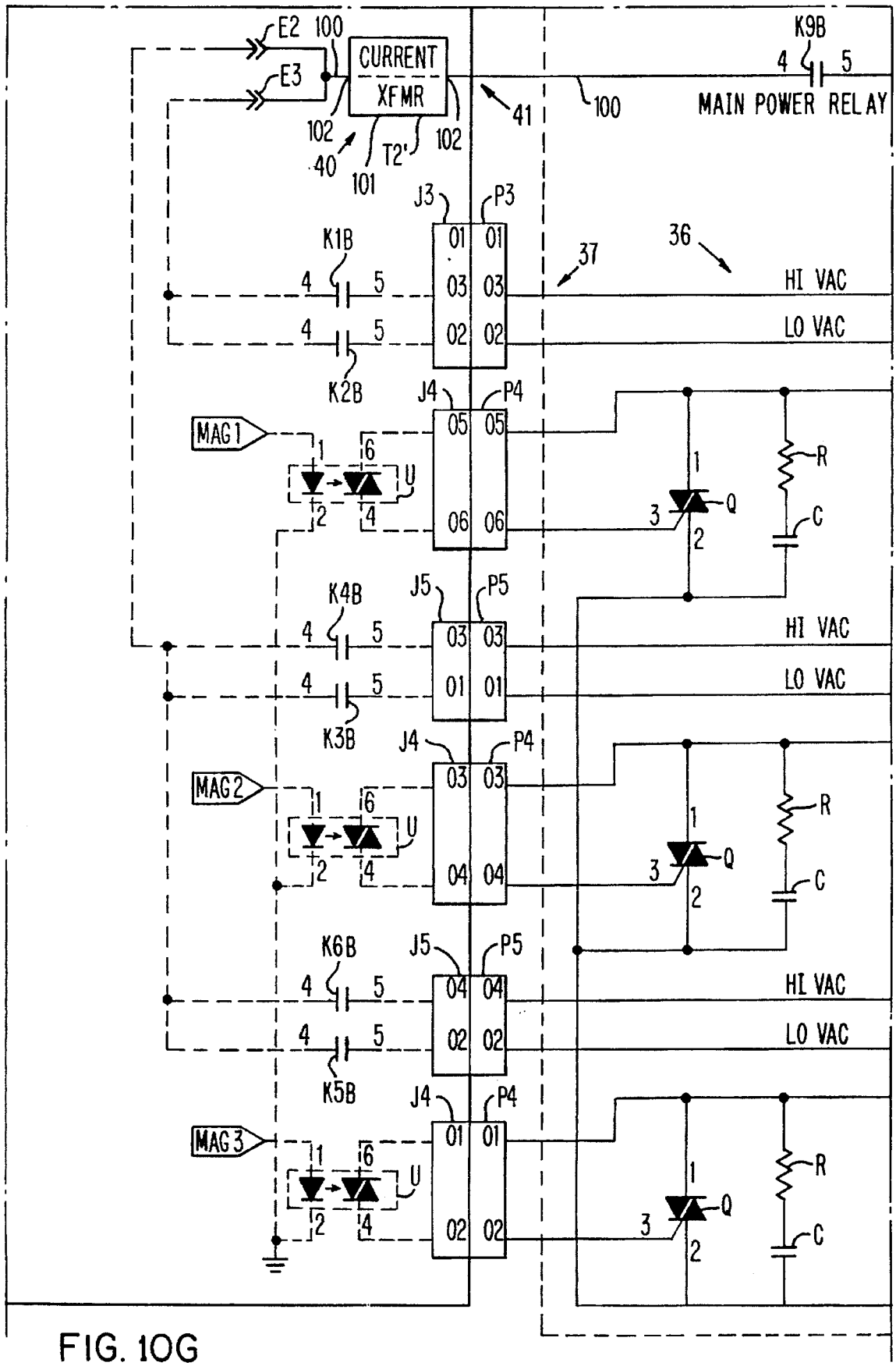
Figure 10H:
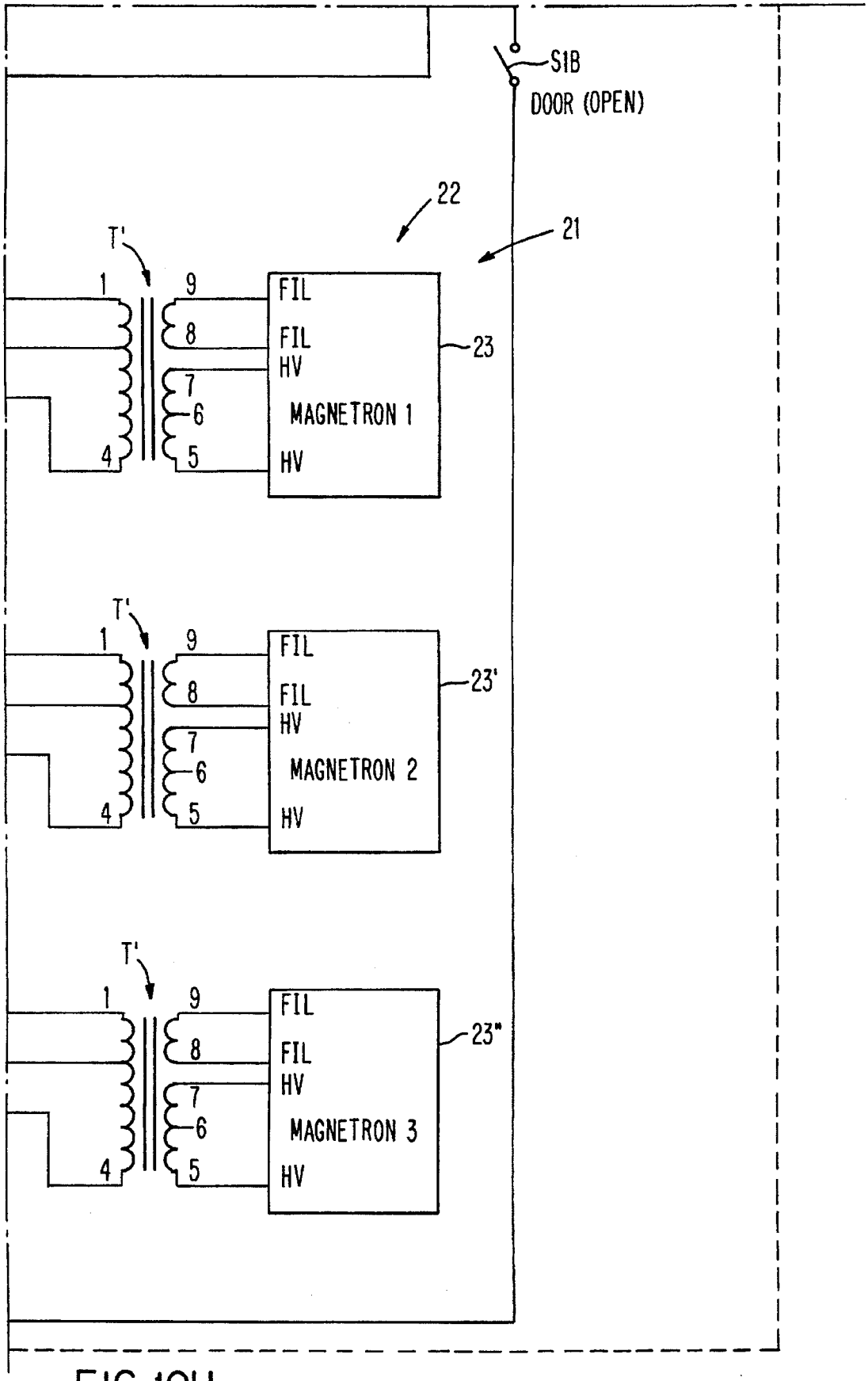

The power board or power module 26 also is used to monitor a photo sensor QPD1, FIG. 10F. This photo sensor QPD1 is typically a photo transistor and it is installed such that the optical input to the photo transistor is measuring the ambient light inside the oven cavity. This photo transistor is interfaced such that the collector of the NPN photo transistor is tied to connector J1'-4, FIG. 4E, and the emitter is tied to connector J1'-5, FIG. 4E. As the light is detected by the photo transistor the voltage at the connector J1'-5 will increase from 0 to 5 volts. Typically in a microwave oven if a metallic article is put in the oven such as a bread wrapper or a utensil of some sort, the magnetron RF energy will cause arcing inside of the oven. The phototransistor is sensitive enough that it will measure this flashing ambient light and will give a positive going signal to the connector J1'-5. The positive voltage at the connector J1'-5 is interfaced through a load resistor R40' and in turn is rectified by diode D8' with a higher impedance back to ground through load resistor R41' that is in parallel with a capacitor C11'. The diode D8' and the capacitor C11' in turn will store or integrate these positive going signals such that a differential amplifier U2D' with its positive input U2D'-12 and its negative input U2D'-13 will provide a scaled analog voltage at the output U2D'-14 of the differential amplifier U2D'. Resistors R42', R45', R43' and R44' are such that the amplitude of the photo transistor from a dark state to a flash or arcing state will provide a voltage of 0 to 5 volts out of the differential amplifier output U2D'-14. This output in turn is interfaced to the microprocessor U1' through a resistor R46' which is a current limiting device into the input channel or port U1'-15 of an A to D converter. The input to the A to D converter is another 8 bit converter and gives a scale factor of 1 out of 256 steps for the input voltage of 0 to 5 volts. In this way the ambient light that is detected by the photo transistor has been scaled so as to detect such things as arcing or in an extreme case it will detect if there is actually a fire emitting this ambient light within the cavity of the microwave oven.

The power board or power module 26 also interfaces to the magnetron circuits through relays and relay drivers but the information as to when the magnetrons should be turned on and for how long they should be turned on is provided by the display module 25 which has the printed circuit board thereof interfaced to the power board through a serial communication means that comprises the wires of the electrical circuit means 27 of FIGS. 8B and 10B. The serial communication means comprises four logic lines or wires which are the serial clock SK line which is interfaced on connector J2'-1 of FIG. 4B, the serial data output line SO which is J2'-2, the serial input line SI which is interfaced on connector J2'-3 and an acknowledge or handshake line HS which is interfaced on connector J2'-4. These four logic lines or wires of the electrical circuit means 27 are used to pass information back and forth between the power board 26 and a connector J2 (FIG. 2F) of the display control board or module 25 which will be hereinafter described. The serial interface is such that there is a serial clock and this serial clock is generated by the board that is transmitting from a source to a receiver. Assuming that the power board or module 26 is a receiver at this stage, the serial input is a data stream that is clocked in by the serial clock SKJ2'-1 and the serial input SIJ2'-3 in FIG. 4B. The data transmitted between the display board 25 and the power board 26 is typically an 8 bit shift register. Thus if the display board 25 is sending information to the power board 26 it will send this 8 bits of information one bit at a time with a corresponding clock pulse SK and the power board 26 in turn will read this information one bit at a time and will use the SK or clock line to shift this information into serial input register of the microprocessor U1'. At the end of the 8 bit data transfer the power board 26 will recognize that it has all 8 bits and it uses this information to store it away into an appropriate memory location of the microprocessor U1.' Then the display board 25 will be notified through the HS signal or handshake that the power board 26 is ready to receive another 8 bit byte of information. This process will resume with a serial shifting of data for a second byte and this will repeat itself until all information that the display board 25 is sending to the power board 26 is complete. The protocol for this serial transmission will be hereinafter described.

In this manner the display board or module 25 provides data to the power board or module 26 and the power board or module 26 will use this data to determine how long and at what duty cycle the magnetron circuits should be controlled to execute the cooking algorithms. The magnetron circuits as previously mentioned have relays to select either a high voltage tap HI VAC or a low voltage tap LO VAC on the magnetron transformer T'. These relays are energized by the power board microprocessor U1' and in particular a transistor Q7' of FIG. 4B is energized by the port R10 of the microprocessor U1' which is port U1'-1. The output from U1-1 is interfaced through resistor R59 to the base of Q7' which subsequently turns on the transistor Q7' and energizes relay coils K1A', K3A' and K5A'. The contacts K1B' (FIG. 4B), K3B' (FIG. 4D) and K5B' (FIG. 4D) of these relay coils K1A', K3A' and K5A' are tied to the power supply terminal E2 (FIG. 4B) and a terminal E3 (FIG. 4D). Terminal E2 is interfaced through contact K1B' to connector J3'-2 and is interfaced to connector P3'-02 which is the low voltage LO VAC tap of the magnetron 1 (FIG. 4F). The terminal E3 (FIG. 4D) is interfaced through K3B' to connector J5'-1 to magnetron 2's low tap of the high side drive of the transformer. Terminal E3 also ties to relay contact K5B' and switches connector J5'-2 and is the magnetron 3 low voltage tap of the high side drive of the magnetron transformer. Thus if the voltage detected by the line voltage sensing means previously discussed is less than 220 volts, the line voltage is applied to the low voltage taps LO VAC of the magnetron transformer T' by the microprocessor U1' through K1B', K3B' and K5B' as previously explained. If the line voltage is greater than 220 volts for example, then the microprocessor U1' will turn on a transistor Q8' rather than the transistor Q7' through microprocessor port R11 (FIG. 4D) which is U1-'2. The output from port U1'-2 is interfaced through a resistor R60' to the base of the transistor Q8' which subsequently turns on and energizes relay coils K2A', K4A' and K6A'. The contacts K2B', K4B' and K6B' for these relay coils K2A', K4A' and K6A' correspondingly are interfaced through terminal E2 and E3. The contact of relay K2B' interfaces to the connector J3'-3 and into the magnetron high voltage tap of the high side of the transformer for magnetron 1. Correspondingly, terminal E3 is interfaced to relay contact K4B' which provides a contact to connector J5'-3 and correspondingly switches a voltage to the magnetron 2 high voltage tap of the high side drive of the transformer. And terminal E3 is interfaced to relay contact K6B' which switches voltage to connector J5'-4 and provides an output to the magnetron 3 high voltage tap of the high side drive of the magnetron transformer.

Therefore, the microprocessor U1' determines if the incoming voltage is greater than 220 volts or less than 220 volts and applies the line voltage to either the low voltage taps by turning on the transistor Q7' and corresponding relays or if the voltage is greater than 220 volts by turning on transistor Q8' and provide voltage to the high voltage taps by using the corresponding relays. The voltage applied to the relays that supply power to the high side either low or high taps of the magnetron transformers is supervised by a door switch SIB' (FIG. 4F) which is interfaced through connectors J1'-7 and J1'-6. This is a contact which is operated by the door and is closed when the door is normally closed. When the door is closed, the relay voltage VR is applied through the connector J1'-6 to the connector J1'-7 which provides 12 volt DC through diode D10' to the high side of the relay coils K1A', K3A', K5A', K2A', K4A' and K6A'. Thus in order to apply voltage through these relay corresponding contacts the oven door must be closed. This door closure logic that is on connector J1'-7 is also interfaced to the microprocessor input port D3 which is U1'-26. This logic level is conditioned by noise filtering and transient suppression which is made up of a resistor R54', which is a resistor from the input to ground, and a diode D9' which is used to suppress any negative going transients and also through the RC network of a resistor R53' and a capacitor C12'. These components are used to provide input conditioning for the noisy logic level of the door switch S1B' into the microprocessor U1' in such a way that the microprocessor U1' will not be damaged and can recognize these logic levels U1'.

The microprocessor U1' is also interfaced to an auxiliary power relay K9B, FIG. 10G, which is a DC coil K9A, FIG. 10F, that is applied to connector J1'-6, FIG. 4B, which is the 12 volt relay supply VR and to connector J1'-8, FIG. 4B, which is the low side of the auxiliary relay. This auxiliary relay is like a power disconnect relay that is only turned on when the microwave oven 21 is in a cooking stage. The auxiliary relay is turned on by energizing a transistor Q9', FIG. 4D, which is turned on by the microprocessor port R20 which is U1'-5. This logic level's high state is interfaced through a resistor R61' to the base emitter of the transistor Q9' which provides a zero logic level at the collector of the transistor Q9' and energizes the relay coil through the RC network of a resistor R56' and a capacitor C14' and also a series diode D13'. The RC network of the resistor R56' and the capacitor C14' apply a full 12 volt DC logic or 12 volt coil voltage to the auxiliary relay coil K9A and subsequently the capacitor C14' will charge up and the resistor R56' will drop some of that 12 volt voltage such that the voltage across the auxiliary coil K9A is reduced and thereby will provide a current limiting of the coil current to minimize the self-heating of the coil.

The microprocessor U1' also has the ability to select the voltage that is applied to the cooling fan and this is interfaced to L1 through contact relay K7B' of connector J1'-5 which is a low voltage tap to the fan motor and correspondingly through contact K8B' and J1'-6 to the high voltage tap of the cooling fan motor. The relay coils K7A' and K8A' are energized by transistors Q10' and Q11' respectively. The transistor Q10' is the low voltage selection for the cooling fan motor and it is turned on by microprocessor port R12 which is U1'-3. This high logic state is applied through a resistor R62' which turns on the transistor Q10' and the collector of the transistor Q10' goes low and thereby energizes relay coil K7A' through the resistor capacitor network of resistor R57' and a capacitor C15' which applies full voltage 12 volts DC to the coil K7A' initially and with the passing of time the capacitor C15' charges up and voltage is dropped across the resistor R57' to reduce the amount of current flowing through the coil K7A' and thereby reduce the heating effect in that coil. Transistor Q11' is used to energize the relay coil K8A' which applies voltage to the high tap of the cooling fan motor. This is accomplished through the microprocessor port R13 which is U1'-4 which provides a high state through a resistor R63' into the base of the transistor Q11' and turns it on and subsequently the collector of the transistor Q11' goes low and turns on the relay coil K8A' in a manner similar to the action of turning on the relay coil K7A'.

The microprocessor U1' also turns on triacs which in turn energize the low voltage side of the magnetron transformers T'. These triacs are energized by triac drivers U3', U4' and U5' (FIGS. 4D and 4F). Magnetron circuit number 1 is turned on by triac driver U5' and subsequently it is energized by transistor Q14' which is turned on by microprocessor port R23 which is U1'-8. The port R23 when going to a high state in turn is interfaced through a resistor R66' to turn on the transistor Q14'. The transistor Q14' is energized to a low voltage state at the collector which applies a zero voltage through a resistor R70' to the cathode of the optical isolator U5.' The anode is interfaced to the relay power supply VR through a diode D10' and through the door switch S1B' which is located at connector J1-7' to connector J1-6'. The optical isolated triac driver U5' is also a triac which has a MT1 terminal interfaced to J4'-5 and an MT2 terminal which is interfaced to J4'-6. When the optical coupled triac driver is turned on the line voltage which is at the MT1 terminal of an external triac Q' (FIG. 4F) is interfaced through the triac of the U5' driver through a resistor R75' through a resistor R76' and into the gate of the same external triac. This provides a trigger voltage for the external triac Q' turns on and provides a switch from the low side of the magnetron transformer T' back to the line voltage L2. Thus in the system 20 the power board or power module 26 selects a relay to apply voltage to one of the high side taps of the magnetron transformer T', either the low voltage tap LO VAC or the high voltage tap HI VAC and the external triac Q' is turned on by the microprocessor U1' on the low side of the magnetron transformer T'. In this manner energy is applied from the primary to the secondary of the magnetron transformer T' to cause the magnetron circuit 23 to conduct energy. This is repeated for magnetron 2 and magnetron 3. Magnetron 2 is energized via the microprocessor port R22' through a resistor R65' into the base emitter of a transistor Q13' which turns on the optical isolated triac driver U4' similar to the magnetron 1 circuit. Also magnetron 3 is turned on by the microprocessor port R21' through a resistor R64' into the base emitter of a transistor Q12' which turns on the triac driver U3' in a manner previously described for magnetrons 1 and 2.

The power circuits of the power board 26 for the magnetrons is supervised by a watchdog circuit. This watchdog circuit has a start logic level which is interfaced from the display board or display control module 25 and a subsequent key closure of the membrane keyboard. This membrane keyboard closure is a zero logic level with respect to ground and is interfaced through a harness to the connector pin J2'-8 of the power board and is labeled "Start" in FIG. 4F. The start signal is also interfaced to a capacitor C17', resistors R78', and R79' and the transistor base of a transistor Q15'. When the start key is pressed, the start signal at the node of the capacitor C17' and the resistor R78' goes low to a ground state. This in turn pulls the base of the transistor Q15' low through a resistor R15' and turns on the transistor Q15' which in turn is interfaced through a resistor R80' to the base of a transistor Q16' and turns on the transistor Q16'. A resistor R81' from the base of the transistor Q16' to the emitter of the transistor Q16' or ground is used as a turn off bias for the transistor Q16'. When the start key is pressed, therefore, the transistors Q15' and Q16' are turned on. This is monitored by the microprocessor U1' from the collector of the transistor Q16' which goes to a low state through a resistor R67' to the input port D2' of the microprocessor U1' which is U1'-25. The microprocessor U1' recognizes then that the start key has been pressed and if cooking program information has also been received from the display board or display control module 25 the microprocessor U1' will turn on the magnetron circuits in the manner previously described and will also commence a watchdog clock signal out of the microprocessor port D1 and this is U1-'24. The signal from the microprocessor port D1 is a square wave signal and is interfaced through the resistor RC network of a resistor R77' and a capacitor C16' to a commutating diode D16' which is tied to VCC and also through the cathode emitter of the diode D17' which provides a negative going strobe to the capacitor C17' the other side of which is interfaced to VCC. In this manner the square wave signal generated by port D1 will provide a half-wave rectified signal which will keep the capacitor C17' formed at some voltage between 0 and 5 volts which is sufficient to maintain the transistor Q15' in an on state. If this voltage square wave at the microprocessor port D1 which is U1'-15 is terminated then capacitor C17' is charged to VCC via resistors R79' and R78' and the transistor Q15' is turned off. The values of the resistor R77' and the capacitors C16' and C17' have been selected such that the capacitor C17' cannot not be initially discharged from its nominal voltage of 0 volts referenced to VCC to a voltage of less than VCC at the capacitor C17' and the resistor R78' node. Thus to initiate the circuit, the start key must be pressed to provide a negative or a zero logic level at the node of the capacitor C17' and the resistor R78' to ini-tially turn on the transistor Q15'. This circuit is called a start supervisory watchdog and is well known in the art.

The printed circuit board for the display control module 25 is illustrated in FIGS. 2A–2F and will now be described in detail.

Figure 2B:
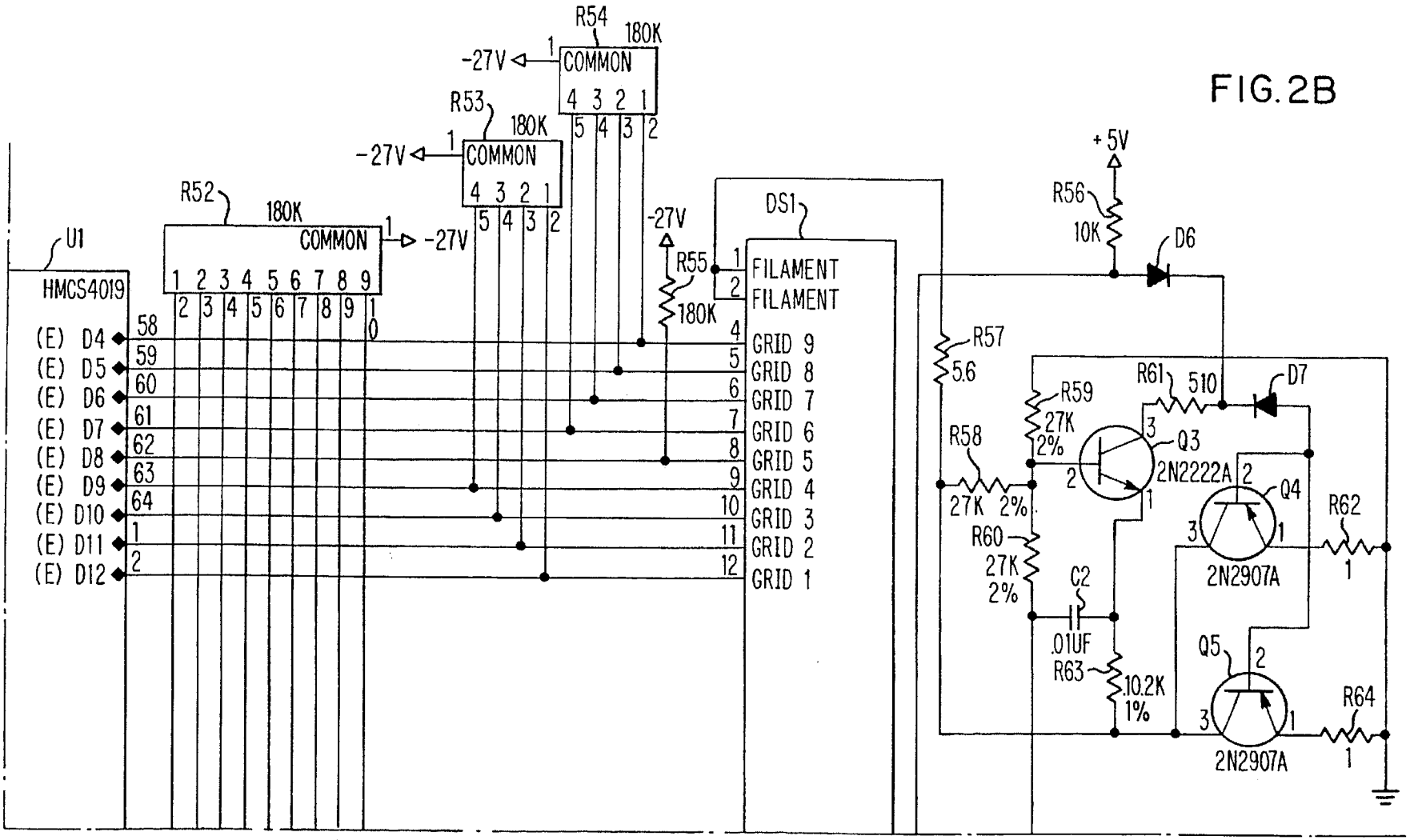

The display board 25 has a membrane keyboard interfaced through connectors J3 and J4 and this is used for inputting data from a user. It also has a display DS1 which is a vacuum fluorescent type of display. This vacuum fluorescent display DS1 has segments which are interfaced from the microprocessor U1 through ports D15–R13 thereof (FIG. 2D) and the display DS1 also has nine grids which are interfaced from the microprocessor U1 through ports D4–D12 (FIG. 2B) .

The VF display DS1 has a filament means which is driven by an oscillator circuit (FIG. 2B) comprising transistors Q3, Q4 and Q5 and this circuit is fully described and claimed in a copending patent application of Brian J. Kadwell, Ser. No. 004,702, filed Jan. 14, 1993, and since the issue fee for this patent application has been paid, this patent application is being incorporated into this disclosure by this reference thereto.

The filament supply is generated from the –27 V VFD and has a series of zener diodes Z2, Z3 and Z4 which are used to regulate the voltage and provide a cathode bias, which is used as a grid turn off for the VF display DS1 in a manner that is well known in the art.

The keyboard means 32 and 33 of the display module 25 is arranged such that each key has two poles which can be switched to a ground potential as illustrated schematically in FIG. 10E. These poles of the keyboard are matrixed into the microprocessor U1 through the ports A0–R90 thereof as illustrated in FIG. 2E. Pressing a key will pull two of these nine lines to a ground potential. The microprocessor U1 recognizes errors such that when only one pole or line is brought to a ground state, a key is not fully pressed. Additionally, if more than two poles or inputs of the microprocessor U1 are pulled to ground, then more than one key has been pressed. So the microprocessor U1 exclusively recognizes when only two of these logic inputs are at a ground potential. The keyboard input is used to provide user interface for programming the microwave oven 21. Information such as the menu that is being used, the item to be cooked, the quantity of that item. Additionally the time that the item is to be cooked can manually be entered via the keyboard.

The normal execution of programs in the microwave oven 21 is such that the menu is selected and this can be one of four menus such as breakfast, lunch, dinner or a prep mode. Then up to two characters can be selected for an item number such as 1 to 99 and then the quantity of the item such as 1 to 9 can be selected. In the automatic mode of operation of the microwave oven 21 a memory has been provided such that this information of menu, item and quantity is converted to preprogrammed cooking times. Typically there can be four cook stages for each item, such that an item will have a first stage with a cook time and power level, which can be followed by a second stage which is a cook time and a power level, followed by a third stage which is a cook time and a power level, followed by a fourth stage which is a cook time and a power level. These stages can also be used for pause states where there is no cooking, but rather a standing time to allow the cooking power and the amount of heat that has already been put into the product to stabilize or have a chance to penetrate into the product. The stages can also be used as a pause which terminates the cooking cycle and allows the operator to open the door, stir the product, and then close the door to resume a cooking operation, such that this mode is an effective means of preparing foods while it is being cooked.

The display board or main board 25 is the system module 25 that is used to execute the cook times to the power module 26. When the user enters an item and a quantity, the information is looked up in a memory and this information in turn is converted into data that is communicated through the serial IO port to the power board 26 and the power board 26 will execute the times and power levels into the magnetron circuits in a manner that has been previously described. The serial interface from the display control module 25 to the power board 26 is illustrated in FIG. 2F and comprises a serial clock SK at J2-1, a serial input SI at J2-2, a serial output SO at J2-3 and a handshake or acknowledge line at HS J2-4, the serial interface being interconnected to the power module 26 by the wires of the electrical circuit means 27 as previously described.

As previously described for the power board 26, the serial communication for the display control module 25 is a shift register and the serial communication can either send or receive data between the power board 26 and the main board or display board 25. In a manner already described the transmission is serialized such that if the display board or main board 25 is sending information to the power board 26, the data is sent from the microprocessor port SO/R42 which is U1-35 as a serial data output line out of J2-3 and this information is clocked by a logic level which is identified on the schematic as port SCLK/R40 which is U1-33. The microprocessor U1 steps this data one data bit per clock pulse and the power board 26 reads this information in in a similar manner one data bit per clock pulse. At the end of this transmission the HS line which is port R43 or U1-36 is used to acknowledge that the transmission is complete and the main board 25 will then set up a second byte of eight bits that can be transmitted to the power board 26 and will continue in this method until all data has been transmitted.

Figure 2C:
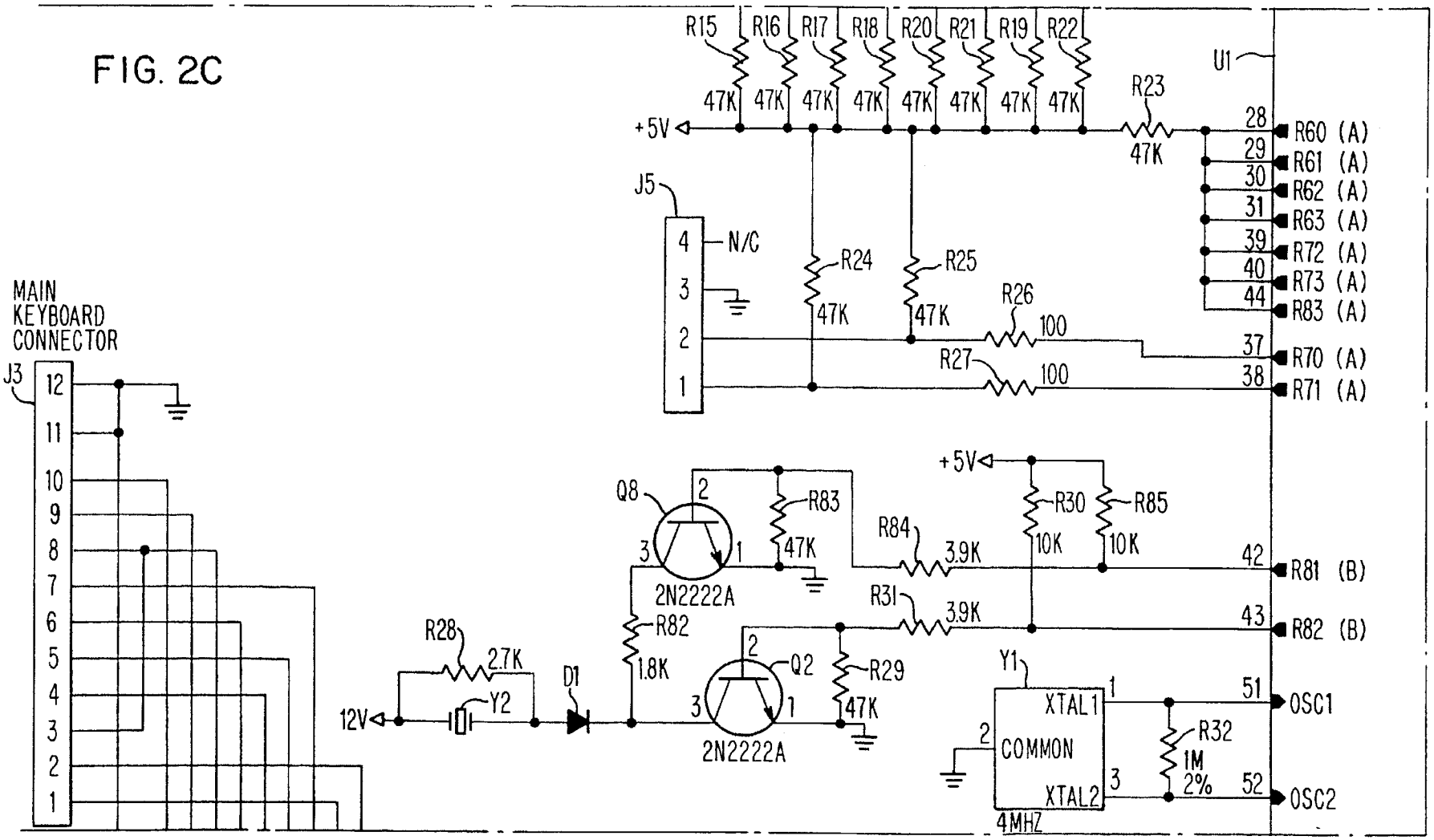
Figure 2D:
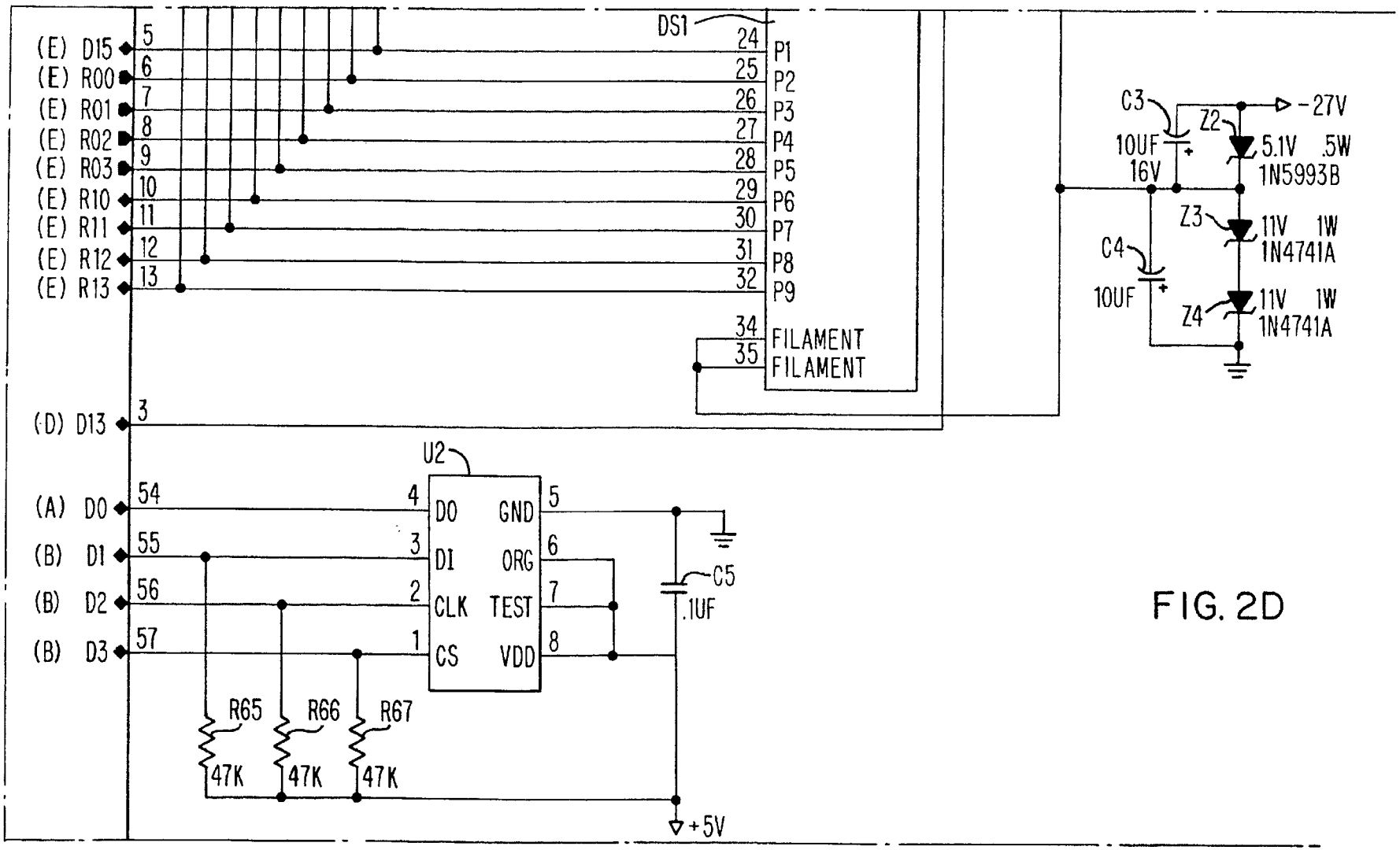
Figure 2E:
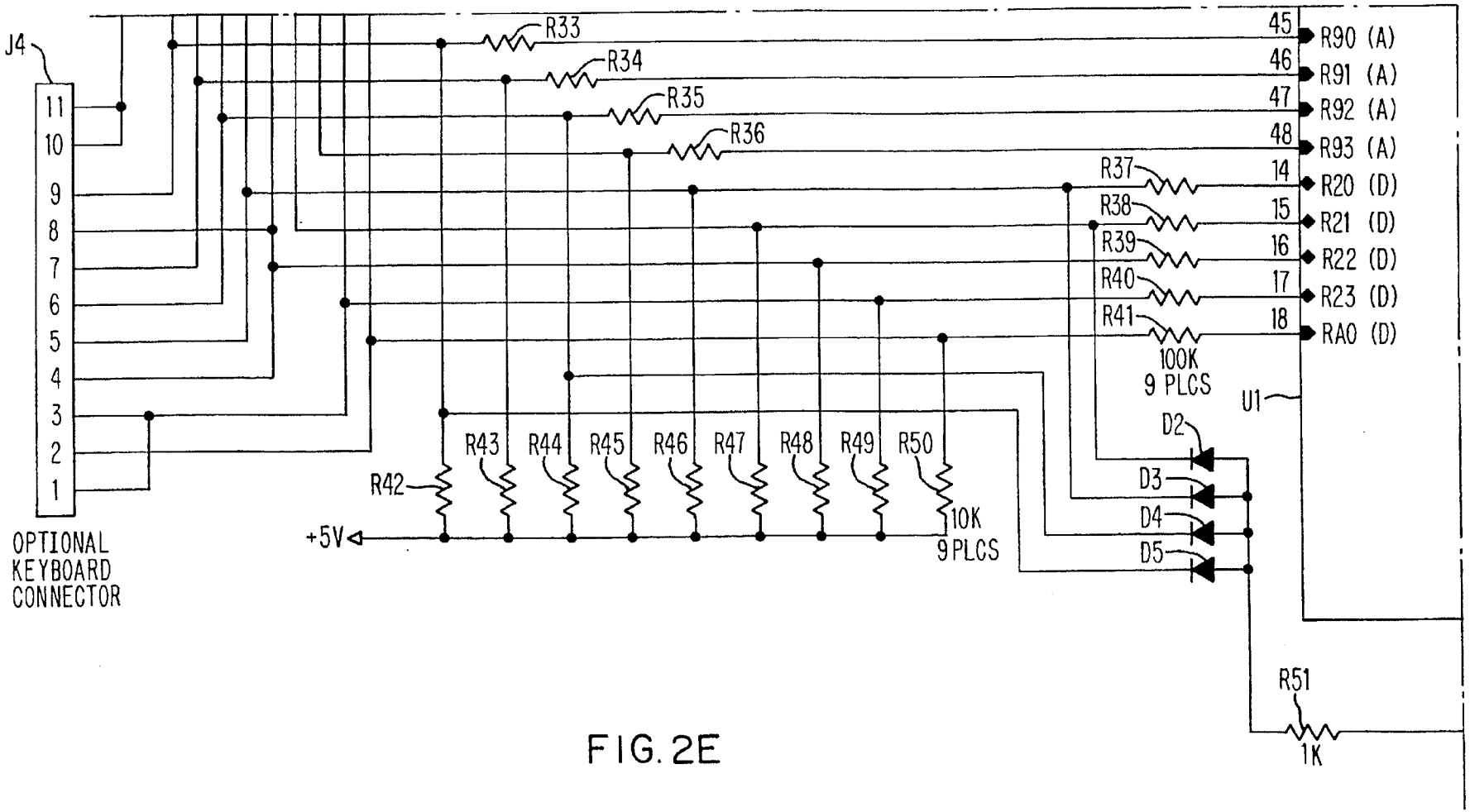
Figure 2F:
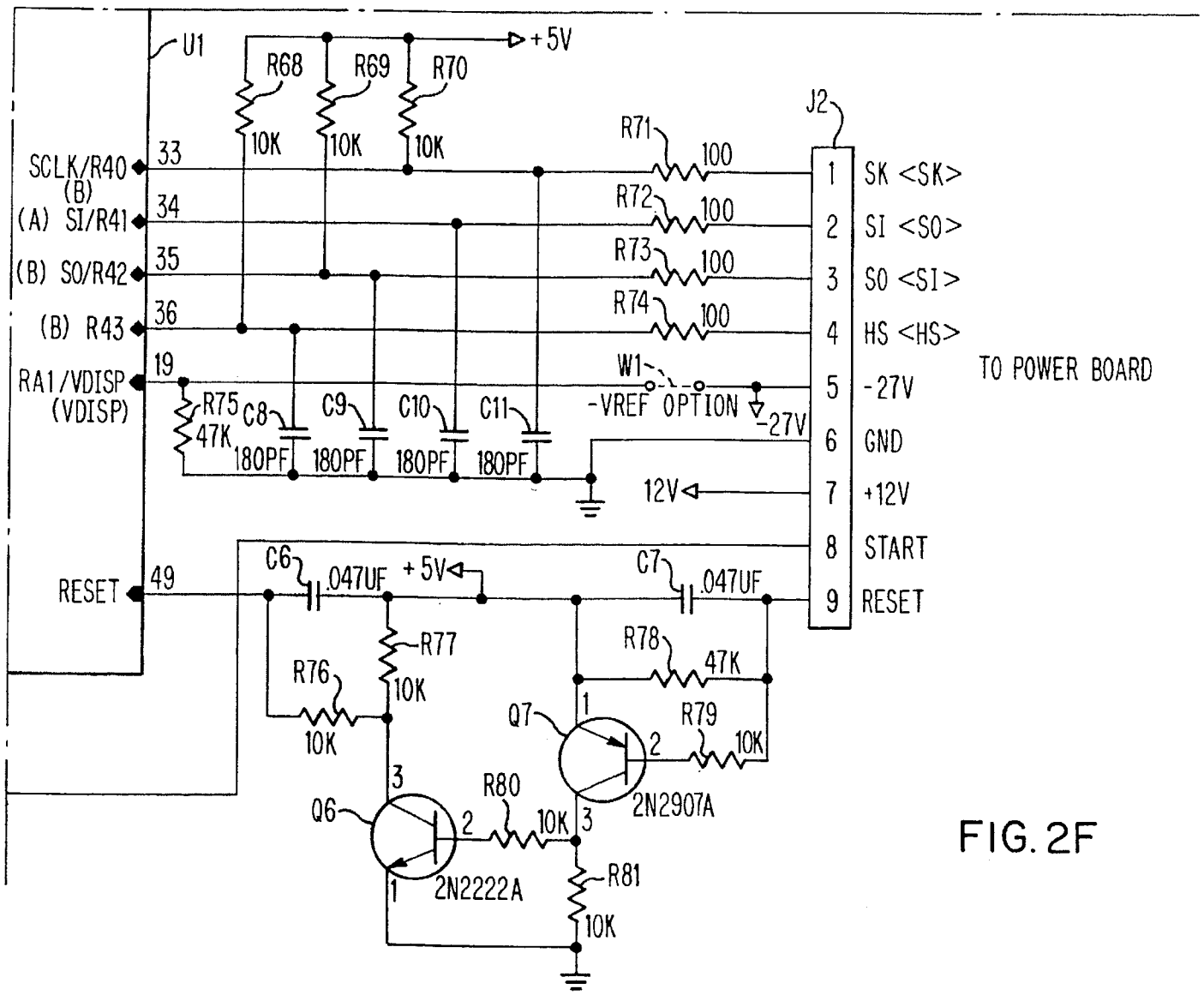

The main board 25 also receives its power supply voltages from the power board 26 and this is interfaced in through the connector J2 as illustrated in FIG. 2F. The ground potential is J2-6 and the 12 volt DC power supply is interfaced in through J2-7. The 12 volts DC is regulated down to 5 volts DC via the power supply regulator transistor Q1 and its associated zener diode D1 which is supplied through resistor R1. The 12 volts is interfaced to the pass transistor through a dropping resistor R5 and is filtered by an electrolyte capacitor C12 as illustrated in FIG. 2A. The resistor R5 and the capacitor C12 are used for filtering and also for noise suppression due to the fact that the 12 volts is being supplied from a power source that is a long distance with wiring that passes through some very noise producing components and circuitry.

The start key which was previously mentioned in the description of the power board 26 is generated by the membrane keyboard which is interfaced through connectors J3 and J4 of FIGS. 2C and 2E. The start key at J2'-7 (FIG. 4B) is switched by J2-8 (FIG. 2F) through a resistor R51 (FIG. 2E) and diodes D2, D3, D4 and D5 to a ground potential when any of the item keys are pressed. In this way when the user presses an item key to select an item the start key is brought to a zero state and arms the watchdog circuit which was previously described in the description of the power board 26.

The power on reset circuit for the microprocessor U1 is interfaced from the power board 26. The power board microprocessor U1' has an output port D5 (FIG. 4B) which is interfaced through a harness or a cable of the electrical circuit means 27 to the input connector J2-9 (FIG. 2F). The power board microprocessor U1' has a timer associated with this and when the power board 26 initially is energized by applying an AC line voltage to the power cord of the microwave oven 21 the microprocessor U1' begins executing its program and provides a delay on signal which is reset to the main board 25. The transistors Q7 and Q6 of FIG. 2F are used to stretch this reset pulse and also condition it for improved noise immunity. When the reset line at. J2-9 goes to a low logic state, the transistor Q7 turns on and provides 5 volts at the collector of the transistor Q7 which in turn turns on the transistor Q6 by applying the 5 volts through a resistor R80 into the base of the emitter of the transistor Q6. The collector of the transistor Q6 in turn goes to a low state which provides a low state at the microprocessor reset input which is U1-49.

The main board 25 also has a EEPROM memory 30 (FIG. 8B) which is used to store time information for the items that are cooked as was previously mentioned and also other parameters such as the voltage level that the line voltage will select either a high voltage tap or a low voltage tap at the relays of the power board 26 to select that input to the magnetron transformer T' as previously described. Also the scaling of the current detector, the scaling of the temperature monitoring and other similar types of parameters are stored in the EEPROM 30 at the factory as optional information.

The microprocessor U1 also has a crystal oscillator circuit which is used as the main time base for the microprocessor U1 and it is represented by the schematic designation Y1 in FIG. 2C. The oscillator input terminals of the microprocessor U1 are U1-51 for oscillator 1 and U1-52 for oscillator 2. The oscillator Y1 is a ceramic resonator and has a nominal frequency of 4 megahertz.

The microprocessor U1 also interfaces to a speaker Y2 in FIG. 2C which is an audio annunciator. The speaker is a ceramic resonator. The speaker Y2 has a parallel resistor R28 which is used to discharge the capacitance of the resonator and is interfaced through diode D1 and transistors Q2 and Q8 which are driven by microprocessor ports R82 which is U1-43 and R81 which is U1-42. It should be noted that the transistor Q2 is an NPN transistor which switches the resonator between 0 and 12 volts whereas the transistor Q8 has a resistor R82 in series with it and switches the resonator through the 1.8 k resistor R82 to ground. Thus transistor Q2 is used to give a full on or a loud annunciation and the transistor Q8 is used to give a softer audible annunciation because it is limited by the resistor R82.

The main board or display control module 25 also interfaces through the circuit means 29 to the LON module 28. The LON module 28 is used to store additional times and recipe information which is converted by the display board 25 and subsequently sends the cooking times off to the power board 26 as was previously described. The communication to the LON module is a 4 bit parallel interface. Schematically illustrated in FIG. 2A pins J1-5 through J1-8 are data bits D0 through D3 and three clock and handshake lines are also used which are represented by Request to Send RTS which is J1-4, acknowledge ACK which is J1-3 and a clock line CLK which is J1-2. These signals in turn will allow transmission of 4 bits of parallel information to be sent between the main board 25 and the LON board 28 in a manner that is understood by those skilled in the art. The data lines in turn interface to the microprocessor U1 via microprocessor ports R30, R31, R32 and R33 and the clock and handshake lines interface to the microprocessor via ports R50, R51 and R52. The resistors in series with these data lines R6–R14 are used to limit current and also give some noise immunity and transient suppression to the microprocessor U1. The pull up resistors tied to these data ports such as R15 (FIG. 2C) going from port R30 to +5 volts are used by the microprocessor U1 when the microprocessor U1 does not have internal pull up resistors such as a universal part rather than a masked programmed part.

The printed circuit board for the LON module 28 is illustrated in FIGS. 6A–6F and will now be described in detail.

Figures 5, 6A:
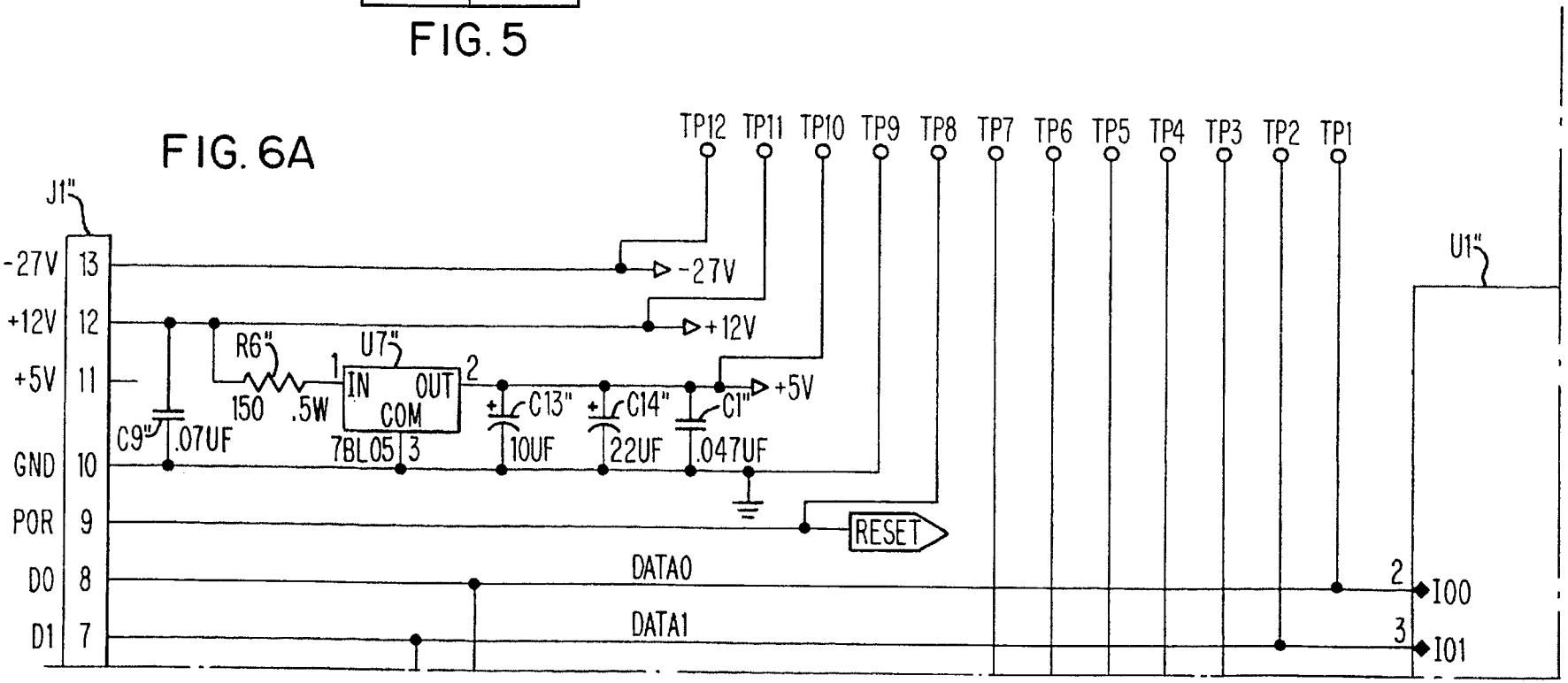
FIG. 5 is a block diagram illustrating how
FIGS. 6A–6F are to be positioned together to provide the control system of the local operating network module of the control system of this invention.

The LON module 28 receives its DC power supply from the main board or display board 25 and subsequently from the power board. The connector J1"-12 of the LON module 28 as illustrated in FIG. 6A receives +12 volts DC which is regulated down to +5 volts DC by the regulator device U7". A capacitor C9" is a decoupling capacitor that is used to attenuate any high frequency noise that might be caused by the external wiring distribution of this power supply voltage.

Figure 6B:
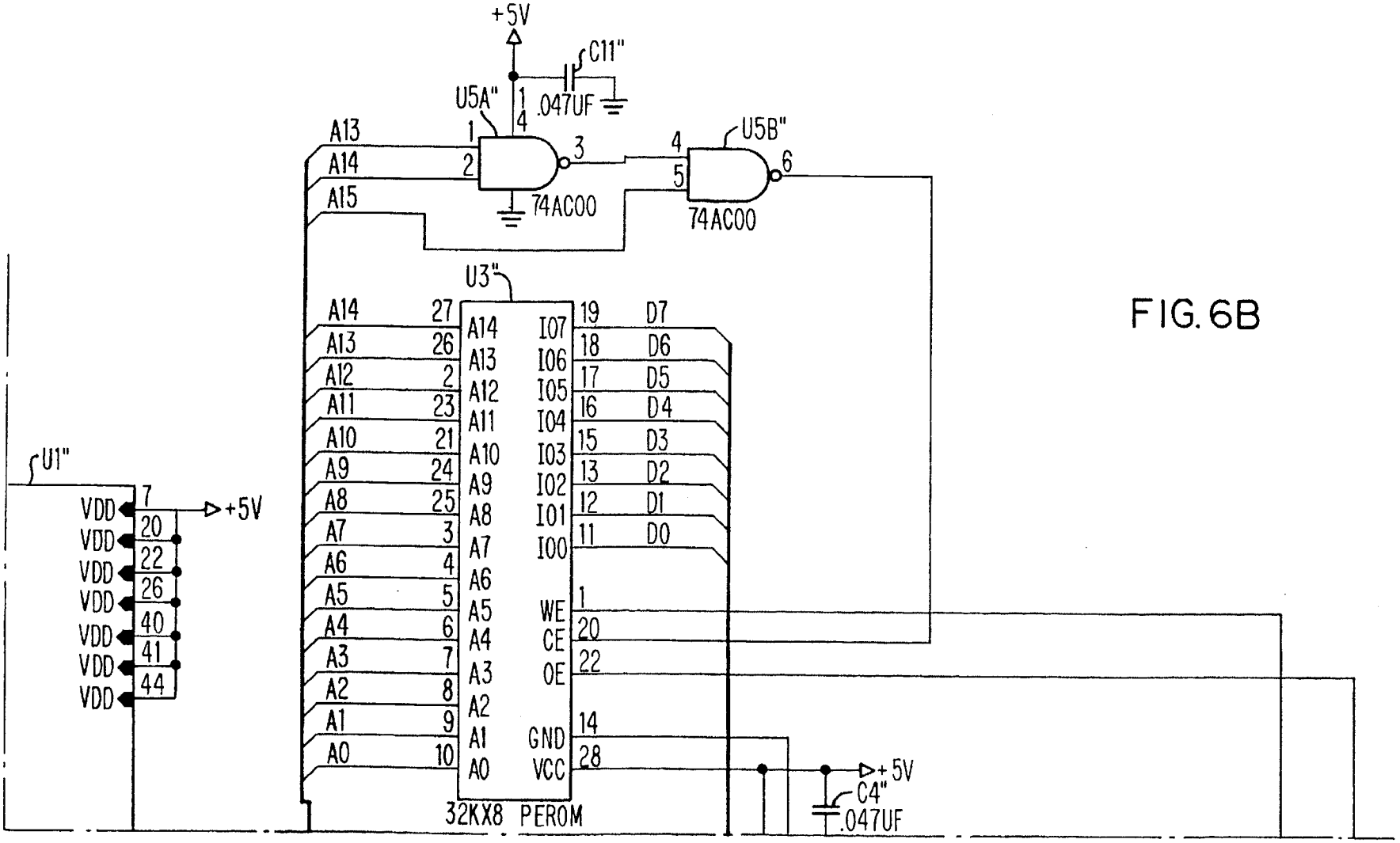
Figure 6C:
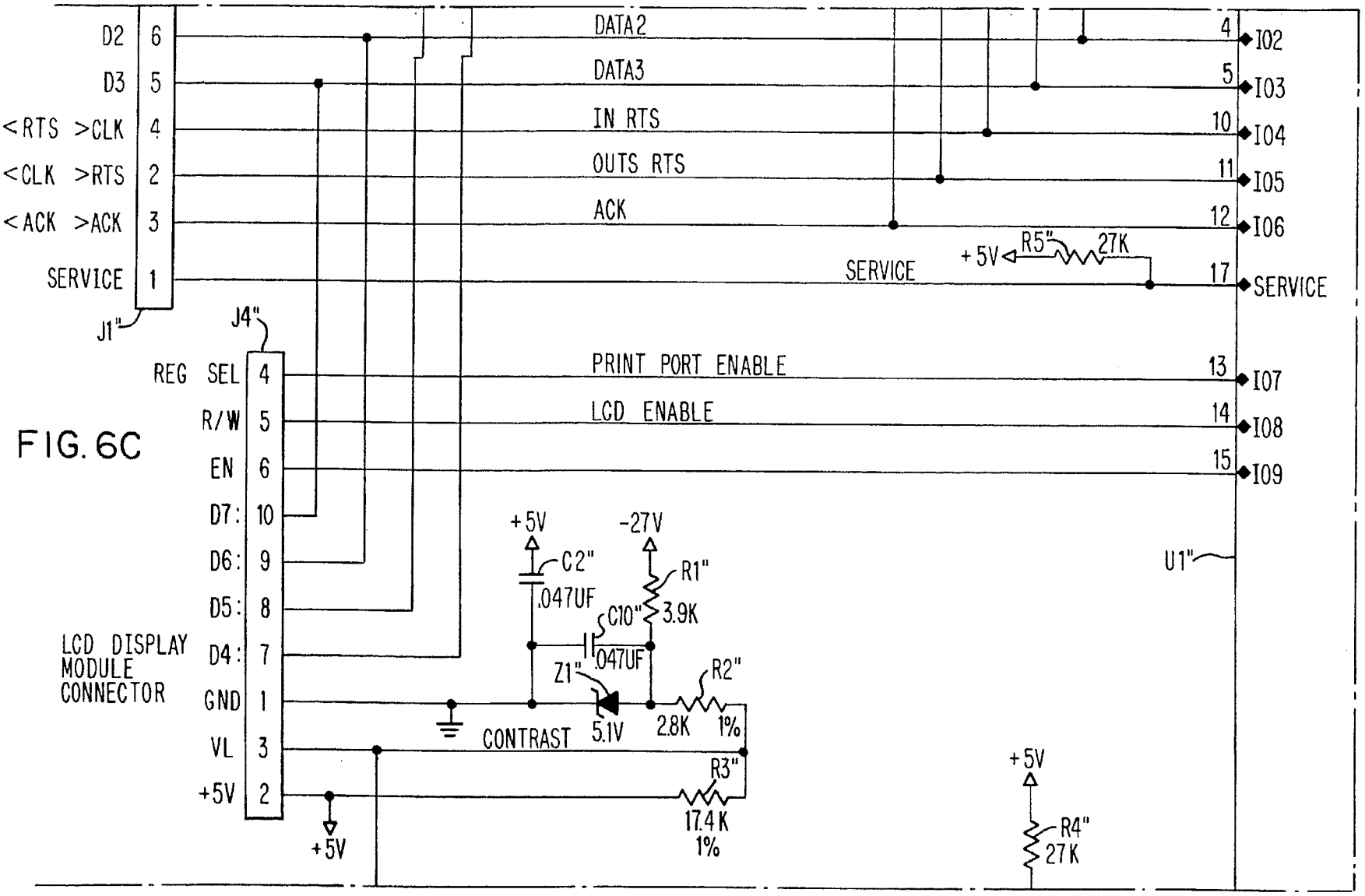

Minus 27 volts is also interfaced via the wiring harness 29 from the main board or display board 25 to the LON module 28 and is used as a reference voltage to establish a contrast ratio for the external alphanumeric module 54 which is an LCD display and it is interfaced through J4" (FIG. 6C).

Figure 6D:
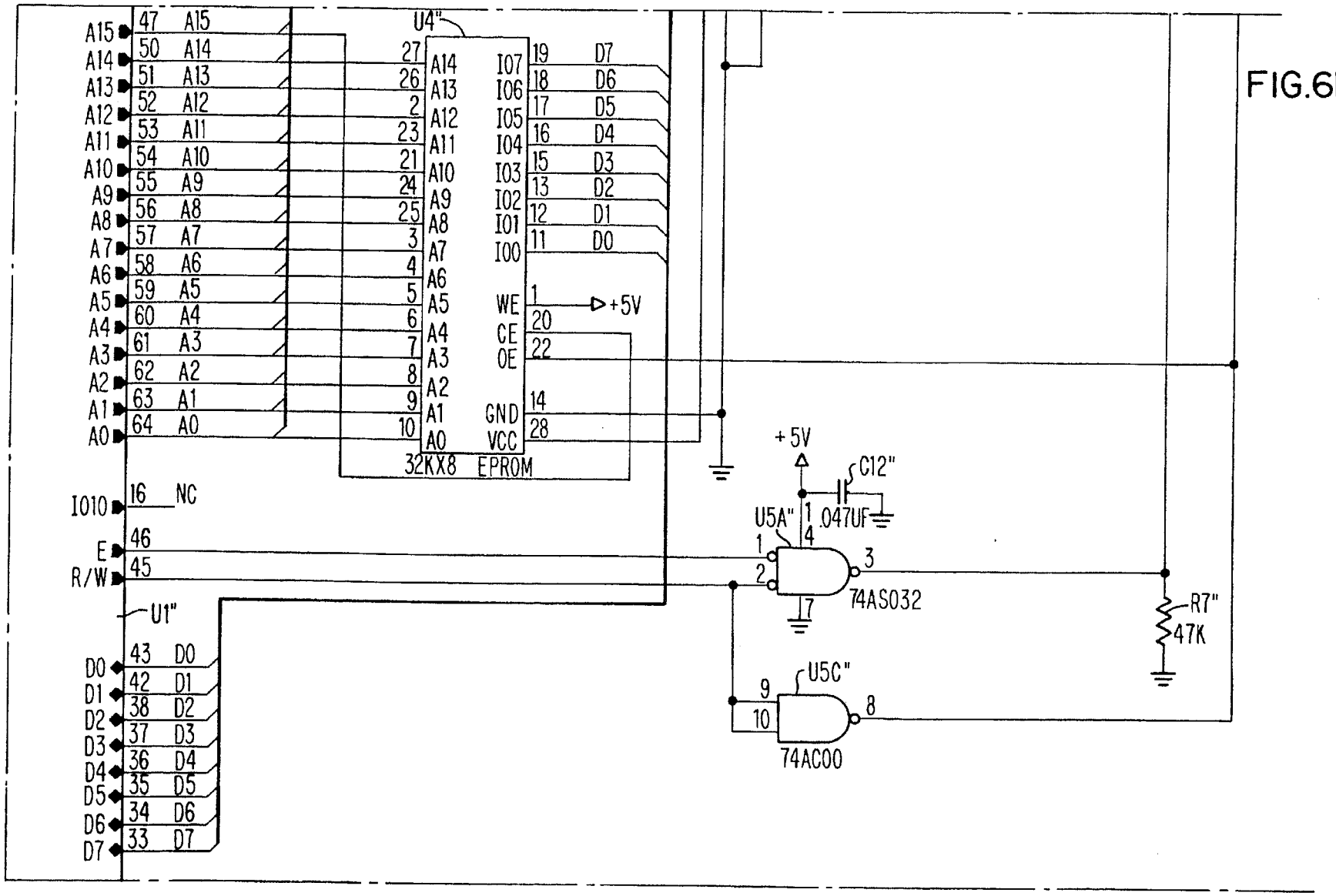
Figure 6E:
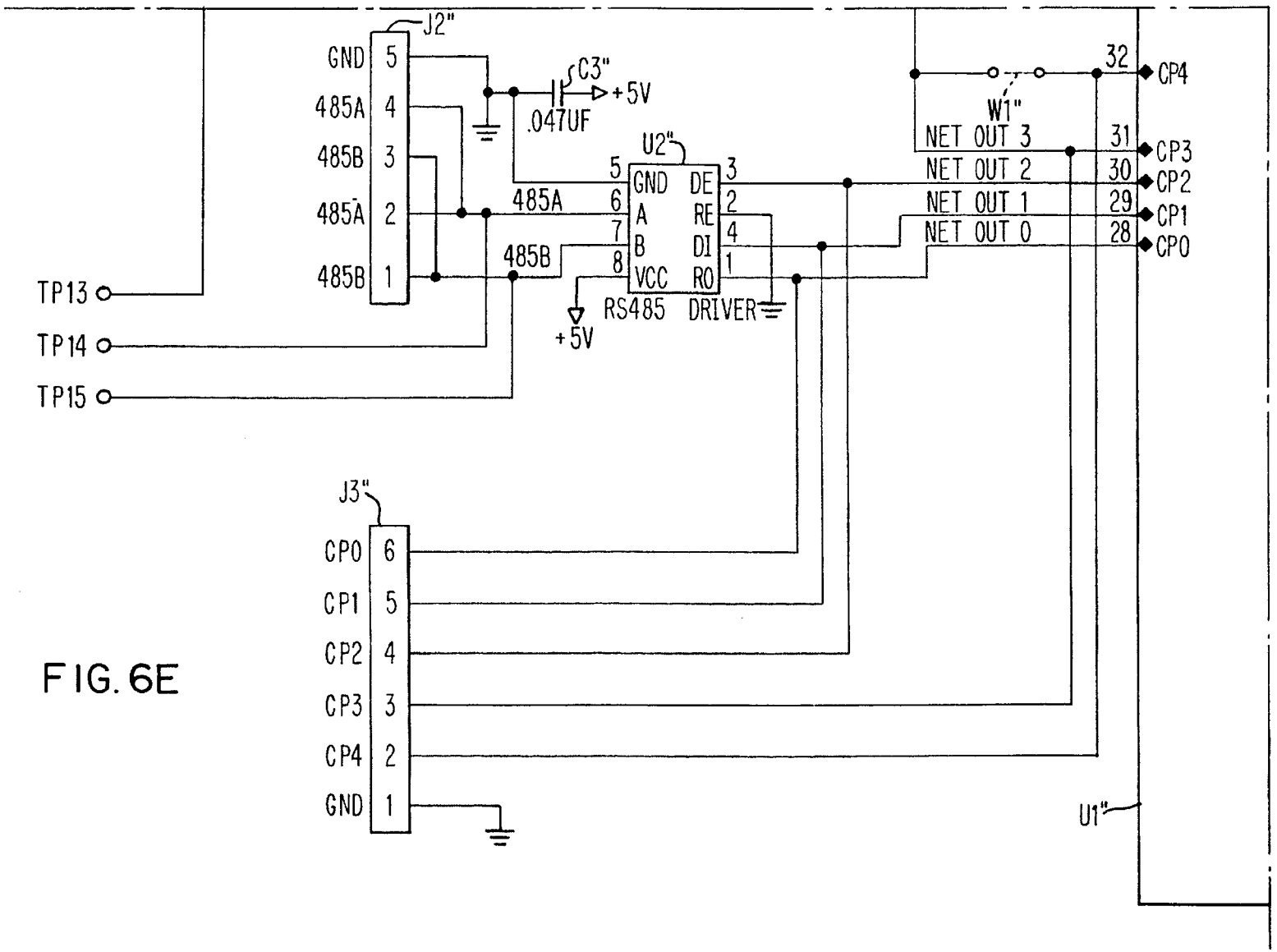

The LONboard or option board 28 has a microprocessor U1". This microprocessor U1" is a chip which is produced and sold by the aforementioned Echelon Corporation under the trademark name NEURON 3150 CHIP. The chip U1" actually has three microprocessors in one integrated circuit. These three microprocessors are time slotted or time shared. One of the three microprocessors, which is an 8 bit CPU and executes a subset of C language, is used for application software. A second of the three microprocessors is used for internal timing of the integrated circuit and the third of the three microprocessors is used as a protocol and timing for interface to a serial communication port. This Neuron IC also has the capability of addressing up to 16 bits of memory addressing as indicated by the output ports A0 through A15 as illustrated in FIG. 6B. From the schematic it shall be noted that two memory devices are bussed to these ports A0–A15 and there is bank switching logic which is referenced by integrated circuits U5A", U5B", U8A", U5C". This bank switching logic is driven by the address lines A0–A15 and also the R/W or read/write line, microprocessor port U1"-45 (FIG. 6D) and also the enable output port E which is U1"-46 (FIG. 6D). In this manner the Neuron IC can interface to a 32K PEROM U3" (FIG. 6B) and also to a 32K EPROM U4" (FIG. 6D). The PEROM U3" is also typically called a flash memory which is similar to an EEPROM device where it can be electrically erased. The main difference is the erasure and the programming of it is done in 64 byte blocks. Typically the Neuron IC will write out to the flash memory U3" 64 bytes of information and this is stored in a RAM. Once that block of information has been written to the flash memory then the electrically erasable or EEPROM is a shadow of the RAM and it is automatically loaded from the 64 byte RAM into the correct block of EEPROM program data. The information that is stored in the 32K EPROM U4" is application software and the information that is stored in the 32K flash memory U3" is user program information consisting of storage for recipe times and alphanumeric data and so forth.

Figure 6F:
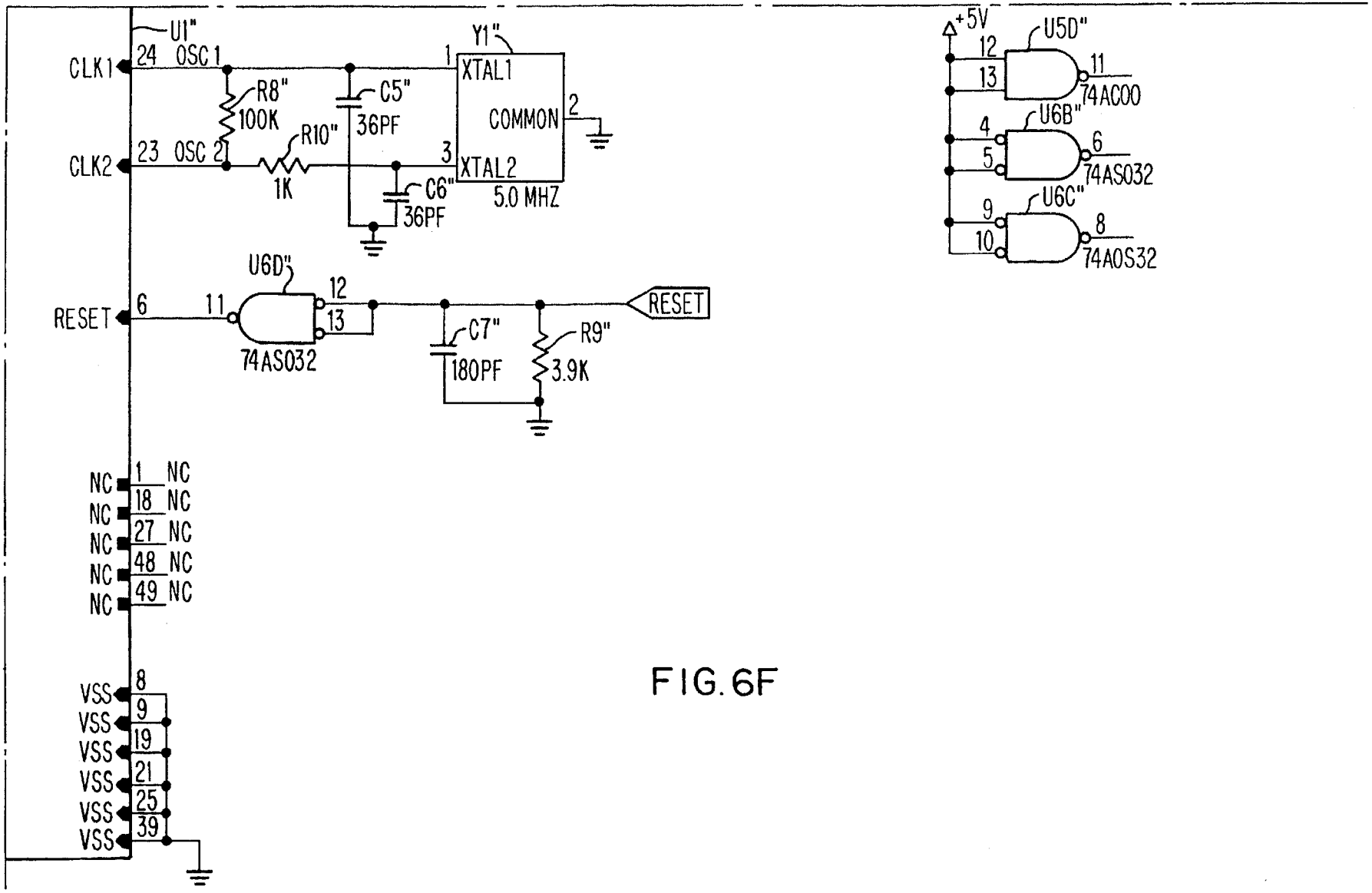

The Neuron IC also has a crystal oscillator Y1" as illustrated in FIG. 6F which interfaces to the Neuron IC clock 1 input U1"-24 and clock 2 input U1"-23. The nominal frequency of this crystal Y1" is 5 megahertz.

The Neuron IC also has a reset input which is designated as U1"-6 (FIG. 6F) and it receives this reset pulse from the main board or display board 25 and its power on reset is the same as the reset for the main board or display board 25.

As mentioned, the third stage of the Neuron IC microprocessor U1" is used to communicate to a serial port. This serial port is interfaced through ports CP0, CP1, CP2 and CP3 (FIG. 6E) to an RS 485 driver chip U2" which is interfaced to connector J2" which has a twisted pair wire that is interfaced to a computer or other microwave oven controls. This is a serial communication via a single twisted pair. The information that is sent to and from the option board via the Neuron input port is encoded in a protocol that has been established by the Echelon Corporation and this protocol is known in the industry by the trademark LONWORKS. The LONWORKS is a communication protocol that is very similar to a modem. It sends out encoded information that has start and stop bits, etc. and has encoded information such that a transmitting device made by Echelon which is another Neuron IC can communicate with other Neuron IC's. This protocol is a standard that has been developed by Echelon and is passive to the system 20, i.e. this protocol is used simply as a transmit and receive means. The data that is transmitted is received in a format that can be decoded and understood by the receiving device in a manner well known in the art.

The application microprocessor U1" of the Neuron IC is used to store information into the flash memory 52 in a manner that has been previously described. This information has been transmitted perhaps from a personal computer 55 via the RS485 line J2" (FIG. 6E) and has been stored into the flash memory 52. This information is a table lookup of times that are recipes for cooking items and so forth. This memory also has the capability of storing alphanumeric information that is loaded into the flash memory 30 in partitioned areas. This partitioned information and stored information can be executed by the LONWORKS Neuron IC, the application microprocessor U1", in such a way that it can be used to display an alphanumeric display. Typically the option board or memory board 28 is interfaced to the LCD alphanumeric display module 54 by connector port J"4 (FIG. 6C) and through the electrical circuit means 53. The information is transmitted as a 4 bit parallel byte from the Neuron IC to the alphanumeric display module via data lines D4, D5, D6, D7 which are J4"-7, J4"-8, J4"-9 and J4"-10 respectively. The connector J4"-6 is an enable line and the connector J4"-5 is a read or write line. The information is put out on the data lines D4-D7 and is strobed into the LCD module 54 via the enable pin or enable signal J4"-6. The LC display 54 also requires a negative voltage potential which is designated as VL on connector J4"-3 and as previously mentioned this voltage is developed by the –27 volts power supply. The LCD module 54 also requires a supply voltage of +5 volts which is interfaced via connector J4"-2.

In this manner then, data is clocked from the Neuron IC ports I01 through I04 (FIGS. 6A and 6C) to the LCD display module 54 and this information is clocked 4 bits at a time and therefore 32 times 2 or 64 4 bit bytes are clocked to the LC display 54 in the sequence that is to be displayed. This information will be continuously displayed until the information is again updated by the application microprocessor of the Neuron IC.

Therefore, it can be seen that this invention not only provides a new control system for a microwave oven, but also this invention provides a new method of making such a control system.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A control system for a microwave oven having a magnetron including a transformer, said control system further comprising an electrical circuit to interconnect an electrical power source through a conductor to said transformer to operate said magnetron, further including an actual amperage detector of the electrical current flowing from said power source through said conductor to said transformer at that time so as to monitor the operating condition of said magnetron; and wherein said actual amperage detector comprises:

a current sampling circuit and means for determining from said current sampling circuit the highest reading on said current having a sinusoidal wave form.

2. A control system as set forth in claim 1 wherein said actual amperage detector comprises a transformer coil having part of said conductor passing therethrough, whereby said transformer coil comprises a secondary coil of a transformer and said part of said conductor comprises a primary of said transformer.

3. A control system as set forth in claim 2 wherein said actual amperage detector comprises a microprocessor having an A to D converter, said electrical circuit comprising a differential amplifier having an input operatively interconnected to said secondary coil and an output operatively interconnected to said A to D converter.

4. A control system as set forth in claim 1 wherein said operating condition that is being monitored comprises the condition of said magnetron becoming conductive.

5. A control system as set forth in claim 1 wherein said magnetron comprises a plurality of magnetrons and wherein said operating condition that is being monitored is the amount of current being drawn when at least one of said magnetrons is being turned on to determine if the particular turned on magnetron is operating at a certain amperage rating thereof.

6. A microwave oven having a magnetron including a transformer, said microwave oven having a control system comprising an electrical circuit having a conductor, to interconnect an electrical power source through said conductor to said transformer to operate said magnetron, wherein said control system comprises an actual amperage detector of electrical current flowing from said power source through said conductor to said transformer at that time so as to monitor the operating condition of said magnetron means; and wherein said actual amperage detector comprises:

a current sampling circuit and means for determining from said current sampling circuit the highest reading on said current having a sinusoidal wave form.

7. A microwave oven as set forth in claim 6 wherein said actual amperage detector comprises a transformer coil having part of said conductor passing therethrough, whereby said transformer coil comprises a secondary coil of a transformer and said part of said conductor comprises a primary of said transformer.

8. A microwave oven as set forth in claim 7 wherein said actual amperage detector comprises a microprocessor having an A to D converter, said electrical circuit comprising a differential amplifier having an input operatively interconnected to said coil secondary and an output operatively interconnected to said A to D converter.

9. A microwave oven as set forth in claim 6 wherein said operating condition that is being monitored comprises the condition of said magnetron becoming conductive.

10. A microwave oven as set forth in claim 6 wherein said magnetron comprises a plurality of magnetrons and wherein said operating condition that is being monitored is the amount of current being drawn when at least one of said magnetrons is being turned on to determine if the particular turned on magnetron is operating at a certain amperage rating thereof.

11. A control system for a microwave oven having a magnetron, said control system comprising:

a current transforming device responding to an input current variably drawn by said magnetron from an external power source, said current transformer producing an output current proportional to said input current;

a scaling device responding to said output of said current transformer, said scaling device producing a scaled, amplified and rectified output proportional to said input current; and a computing device responding to said scaling device, wherein said computing device determines the actual amperage of said input current so as to monitor the operating condition of said magnetron; and wherein said computing device comprises an analog to digital converter connected to said scaling device output; and said computing device determines the actual amperage of said input current by taking several samples of digital signals which corresponds to said input current thereby finding the highest reading of a sinusoidal wave form to determine the peak current.

12. The control system of claim 11, wherein said scaling device comprises a differential amplifier.

13. The control system of claim 11, wherein said output from said scaling device is scaled to be a maximum of 5 volts DC when said input current is greater than 30 amps.

14. The control system of claim 11, wherein said microwave oven has several magnetrons and said computing device monitors the operating condition of said several magnetrons.

15. A method of controlling a microwave oven having a magnetron, comprising the steps of:

transforming magnetic flux from an input current variably drawn by said magnetron from an external power source to a corresponding signal, wherein said corresponding signal is proportional to said input signal;

determining the amperage of said input current from said corresponding signal; and monitoring the condition of said magnetron from the determined amperage of said input current; and wherein said step of determining the amperage comprises:

sampling said corresponding signal; and determining the highest reading on said input signal having a sinusoidal wave form from said sampling of said corresponding signal.

16. The method as set forth in claim 15, further comprising the step of converting said corresponding signal from an analog signal to a digital signal.

17. The method as set forth in claim 15, wherein said transforming step comprises:

transforming the magnetic flux from said input current to a small AC signal;

rectifying said small AC signal; and scaling said small AC signal such that said input current will generate said corresponding signal.

18. The method as set forth in claim 15, wherein said operating condition being monitored comprises the condition of said magnetron becoming conductive.

19. The method as set forth in claim 15, wherein said operating condition being monitored comprises the time it takes for said magnetron to start conducting.

20. The method as set forth in claim 15, wherein said microwave oven having a plurality of magnetrons, said step for monitoring further comprises monitoring the condition of said plurality of magnetrons.

21. A microwave oven controller comprising:

means for transforming magnetic flux from an input current variably drawn by said magnetron from an external power source to a corresponding signal, wherein said corresponding signal is proportional to said input signal;

means for converting said corresponding signal from an analog signal to a digital signal;

means for determining the amperage of said input current from said corresponding signal; and means for monitoring the condition of said magnetron from the determined amperage of said input current; and wherein said means for determining the amperage comprises:

means for sampling said corresponding signal; and means for determining from said means for sampling the highest reading on said input signal having a sinusoidal wave form.

22. A microwave oven controller according to claim 21, wherein said means for transforming comprises:

means for transforming magnetic flux from said input current to a small AC signal;

means for rectifying said small AC signal; and means for scaling said small AC signal such that said input current will generate said corresponding signal.

23. A microwave oven controller according to claim 21, wherein said operating condition being monitored comprises the condition of said magnetron becoming conductive.

24. A microwave oven controller according to claim 21, wherein said operating condition being monitored comprises the time it takes for said magnetron to start conducting.

25. A microwave controller according to claim 21, wherein said microwave oven has a plurality of magnetrons, said means for monitoring further comprises at least means for monitoring the condition of said plurality of magnetrons.

* * * * *